US006484974B1

(12) United States Patent
Franke et al.

(10) Patent No.: US 6,484,974 B1
(45) Date of Patent: Nov. 26, 2002

(54) CONTROLLER FOR SWITCH MACHINE

(75) Inventors: Raymond C. Franke, Glenshaw, PA (US); Robert P. Bozio, Pittsburgh, PA (US); Leonard M. Wydotis, Louisville, KY (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 0 days.

(21) Appl. No.: 09/951,141

(22) Filed: Sep. 10, 2001

(51) Int. Cl.[7] ..... B61L 5/00
(52) U.S. Cl. ..... 246/476; 246/220
(58) Field of Search ..... 246/217, 260, 246/220, 223, 225, 253, 476, 448, 219, 263

(56) References Cited

U.S. PATENT DOCUMENTS 3,360,645 A 12/1967 Albertson, Jr. et al.
3,748,540 A 7/1973 Eggenberger et al.
3,818,330 A 6/1974 Hiroshima et al.
3,829,850 A 8/1974 Guetersloh (List continued on next page.)

*Primary Examiner*—Mark T. Le
(74) *Attorney, Agent, or Firm*—Kirk D. Houser; Eckert Seamans Cherin & Mellott, LLC

(57) ABSTRACT

A switch machine electronic controller includes a point detecting circuit having Namur sensors for detecting an indication rod target in first and second point positions, and a lock detecting circuit having Namur sensors for detecting a lock box target in first and second lock positions. A microprocessor processes the signals to provide Normal and Reverse outputs. The Normal output is enabled when the first point and lock detection signals have values within a predetermined ON value range, and the second point and lock detection signals have values within a predetermined OFF value range. The reverse output is enabled when the second point and lock detection signals have values within the ON value range, and the first point and lock detection signals have values within the OFF value range. Both outputs are disabled when any of the signals has a value that corresponds to a shorted, open or indeterminate value range.

40 Claims, 7 Drawing Sheets

U.S. PATENT DOCUMENTS 3,931,571 A 1/1976 Hocking et al.
4,349,814 A 9/1982 Akehurst
4,433,309 A 2/1984 Hermle et al.
4,446,427 A 5/1984 Lovrenich
4,477,870 A 10/1984 Kraus
4,521,769 A 6/1985 Dudeck et al.
4,574,266 A 3/1986 Valentine
4,610,206 A 9/1986 Kubala et al.
4,654,645 A 3/1987 Yamagishi
4,845,435 A 7/1989 Bohan, Jr.
4,868,538 A 9/1989 Ballinger et al.
4,881,071 A 11/1989 Monterosso et al.
4,901,008 A 2/1990 Quastel et al.
4,912,471 A 3/1990 Tyburski et al.
4,977,530 A 12/1990 Cline et al.
5,043,648 A 8/1991 Strenzke
5,063,516 A 11/1991 Jamoua et al.
5,116,006 A 5/1992 Ocampo
5,142,235 A 8/1992 Matsumoto et al.
5,192,038 A 3/1993 Ocampo
5,218,298 A 6/1993 Vig
5,247,245 A 9/1993 Nelson
5,329,238 A 7/1994 Hofsass et al.
5,418,453 A 5/1995 Wise
5,430,434 A 7/1995 Lederer et al.
5,436,614 A 7/1995 Torikoshi et al.
5,504,405 A 4/1996 Hager
5,510,773 A 4/1996 Rodgers
5,534,849 A 7/1996 McDonald et al.
5,623,254 A 4/1997 Brambilla et al.
5,638,057 A 6/1997 Williams
5,729,208 A 3/1998 Ogiwara
5,777,557 A 7/1998 Fayfield
5,789,925 A 8/1998 Yokotani et al.
5,806,809 A 9/1998 Danner
5,844,411 A 12/1998 Vogt
5,868,360 A 2/1999 Bader et al.
5,880,614 A 3/1999 Zinke et al.
5,917,320 A 6/1999 Scheller et al.
5,917,776 A 6/1999 Foreman
5,959,538 A 9/1999 Schousek
5,962,934 A 10/1999 Fendt et al.
5,963,135 A 10/1999 Van Marcke
5,986,549 A 11/1999 Teodorescu
5,988,798 A 11/1999 Hirasawa et al.
6,011,477 A 1/2000 Teodorescu et al.
6,016,104 A 1/2000 Dobler et al.
6,023,228 A 2/2000 Benke et al.
6,062,514 A 5/2000 McQuistian
6,138,959 A 10/2000 Wydotis et al.
6,164,600 A * 12/2000 Seidl et al. ..... 246/220
6,186,448 B1 2/2001 Wydotis et al.
6,296,208 B1 10/2001 Franke

* cited by examiner

FIG.5
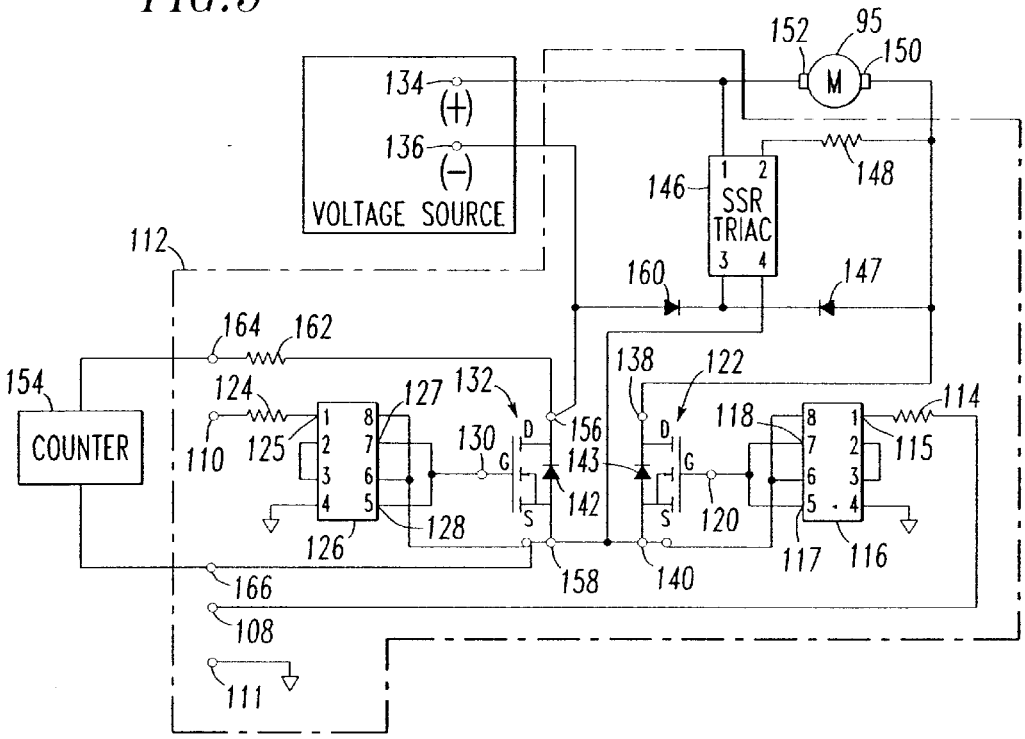
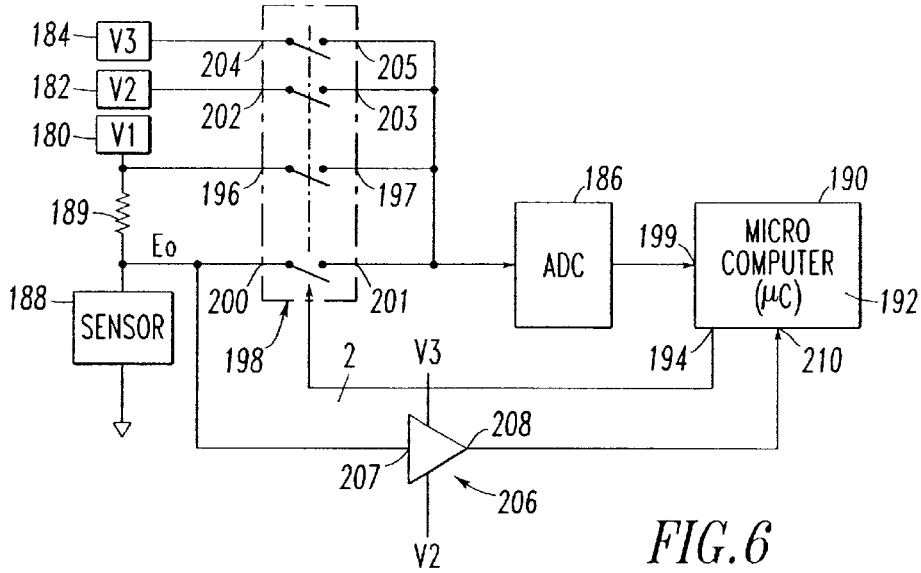
FIG.6

CONTROLLER FOR SWITCH MACHINE

CROSS-REFERENCE TO RELATED APPLICATION

This application is related to commonly assigned U.S. patent application Ser. No. 09/382,439, filed Aug. 25, 1999, now U.S. Pat. No. 6,296,208, entitled "Railway Switch Machine Point Detection System".

BACKGROUND OF THE INVENTION

1. Field of the Invention

This invention relates to controllers for switch machines and, more particularly, to electronic controllers for railway switch machines or for transit and/or railway related vital proximity detection applications.

2. Background Information

A railway switch machine is used to divert a train from one track to, another track. In many cases, the switch machine is remotely operated and, thus, an operator cannot see the machine. Consequently, the status of the machine (e.g., points detected and mechanically locked for either a straight-through or turn-out move) is provided by electrical circuits that, in turn, are interlocked with signals governing movement of the trains. According to typical convention, the term Normal (N) is employed for a straight-through move and the term Reverse (R) is employed for a turn-out move.

Historically, indication circuits for switch machines were implemented with cam operated or other types of mechanical switches within the machine. In some cases, the indication contacts of one machine are electrically connected in series with other machines. All interconnected machines must prove that their points are closed and mechanically locked before railroad signals are cleared, in order to permit movement of associated trains.

Motor control is also provided by mechanical switches. Basically, the motor rotates in opposite directions for Normal and Reverse. Rotary motion of the motor is converted to linear motion within the machine to move and lock the points. If the motor is being driven Normal, then contacts within the machine open the circuit path that would, otherwise, permit continued movement in that direction when the limit of intended motion is reached. However, a path is maintained that permits movement in the Reverse direction. In between the extreme positions, both current paths are closed for movement of the motor in either direction.

It is known to assign Right Hand Points Closed (RHPC) or Left Hand Points Closed (LHPC) to Normal by orientation of cam operated switches.

With mechanical controllers, a battery voltage is fed from the wayside case to contacts of a first switch machine. Then, if those contacts are closed, the battery voltage is fed on to the next machine, and so on. If all the contacts in the, series string are closed, then the voltage fed back to the wayside case proves all switch machines are in correspondence, which is a condition necessary to clear signals.

U.S. Pat. No. 5,806,809 discloses inductive proximity sensors, which are employed to detect the position for a railroad switch machine.

It is a known practice with mechanical machines to interrupt an indication output when hand operation of the machine is initiated.

U.S. Pat. No. Nos. 5,116,006; and 5,192,038 disclose safety detectors for a railroad switch point.

U.S. Pat. No. 5,504,405 discloses a switch machine controller with a fail safe mechanism.

U.S. Pat. No. 5,142,235 discloses a detection system in which a proximity switch and a controller are connected by a pair of wires. A small leakage current exists when the sensor is in a normal off state, and another electric current flows in a normal on state. One side of the proximity switch is electrically connected to a power source by one wire, while the other side is electrically connected to ground by the series combination of the other wire and a resistor. A set of four comparators receives four different reference voltages from five series resistors between the power source and ground. These comparators also receive a divider voltage, which is formed by the proximity switch and the resistor. A logic circuit receives the outputs of the four comparators and determines one of five states: (1) short circuit; (2) normal on; (3) unstable; (4) normal off; and (5) line breakage.

U.S. Pat. No. 5,218,298 discloses a magnetic-field monitor including a Hall sensor having two terminals. The sensor is energized by applying a DC voltage across these terminals. A Hall-sensor signal decoder circuit includes a current mirror circuit having transistors, a saturating high-current protection circuit, a voltage divider circuit including series resistors, and three comparators having reference voltages and outputs, respectively. The signal decoder circuit is electrically connected to the Hall sensor such that a current, Id, which is proportional to the Hall sensor current, Is, flows through the divider resistors. The three binary output signals from the comparators constitute a binary indication of whether a short circuit fault, an open circuit fault, or a high or low ambient magnetic field exists at the sensor.

U.S. Pat. No. 4,574,266 discloses a microcomputer controlled monitoring system including a load detector circuit for detecting an electrical open, shorted or operative condition of an electrical load.

U.S. Pat. No. 5,986,549 discloses a resonant sensor system, which may be employed in an object proximity-sensing mode.

U.S. Pat. No. 6,062,514 discloses a railway switch circuit controller, which employs eddy current proximity sensors to determine when a railway switch is in a normal or a reverse position.

U.S. Pat. No. 5,418,453 discloses diagnostics for variable reluctance wheel speed sensors. These diagnostics detect sensor and harness short and open circuits by comparing signals to programmable thresholds and time limits.

U.S. Pat. No. 5,868,360 discloses a vehicle presence detection system. If a search coil is shorted, then the voltage change at a subsequent operational amplifier will be absent or greatly attenuated. If, on the other hand, the coil is open, then one operational amplifier saturates at its upper voltage limit and another operational amplifier saturates at its lower voltage limit. In turn, the disappearance of a carrier during self-test, thus, indicates an open search coil.

U.S. Pat. No. 5,844,411 discloses a diagnostic circuit for detecting fault conditions in a Hall effect digital gear tooth sensor in a vehicle's four-wheel drive system. The diagnostic circuit is designed such that a fault, whether it be a short circuit or an open circuit, causes the voltage at specific points to fall below or rise above predetermined values. When a window comparator circuit detects a voltage level outside the specific range of values, it provides a signal to a system controller. The system controller then sends a signal to an indicator, which alerts the driver of the vehicle that a problem exists.

U.S. Pat. No. 5,247,245 discloses a test apparatus for different electrical sensors. A magnetic sensor is operating properly if a red LED indicator flashes on whenever the sensor is passed near ferrous metal or a magnet. The sensor is defective or inoperative if, instead, the red LED indicator never comes on meaning that an open circuit condition exists in the sensor. If the indicator always stays on, then this means that the sensor is shorted out. A proximity (or Hall Effect) sensor is operating properly if the red LED indicator changes its condition whenever placed next to the proper size magnet, regardless of whether the LED indicator was on or off before being placed next to the magnet.

There remains the substantial need (e.g., personnel safety, equipment safety) to provide a fail-safe controller for a switch machine.

SUMMARY OF THE INVENTION

This need and others are met by the present invention in which enhanced safety is provided in a controller for a switch machine by distinguishing ON and OFF sensor states from indeterminate sensor states for two sensors of both point detecting means and lock detecting means.

In accordance with the invention, a controller for a switch machine comprises: point detecting means for detecting when an indication rod is in a first point position and when the indication rod is in a second point position, the point detecting means including a first proximity sensor for detecting a target of the indication rod when the indication rod is in the first point position and a second proximity sensor for detecting the target of the indication rod when the indication rod is in the second point position, the first proximity sensor generating a first point detection signal and the second proximity sensor generating a second point detection signal, the first point detection signal having a value within a first predetermined range of values when the indication rod is in the first point position and having a value within a second predetermined range of values, which is different from the first predetermined range of values, when the indication rod is not in the first point position, the second point detection signal having a value within a third predetermined range of values when the indication rod is in the second point position and having a value within a fourth predetermined range of values, which is different from the third predetermined range of values, when the indication rod is not in the second point position; lock detecting means for detecting when a lock box is in a first lock position and when the lock box is in a second lock position, the lock detecting means including a first proximity sensor for detecting a target of the lock box when the lock box is in the first lock position and a second proximity sensor for detecting the target of the lock box when the lock box is in the second lock position, the first proximity sensor of the lock detecting means generating a first lock detection signal and the second proximity sensor of the lock detecting means generating a second lock detection signal, the first lock detection signal having a value within a first predetermined range of values when the lock box is in the first lock position and having a value within a second predetermined range of values, which is different from the first predetermined range of values of the first lock detection signal, when the lock box is not in the first lock position, the second lock detection signal having a value within a third predetermined range of values when the lock box is in the second lock position and having a value within a fourth predetermined range of values, which is different from the third predetermined range of values of the second lock detection signal, when the lock box is not in the second lock position; means for processing point detection information from the first and second point detection signals and the first and second lock detection signals to provide a first output and a second output, the means for processing enabling the first output when the first point detection signal has a value within the first predetermined range of values thereof, the second point detection signal has a value within the third predetermined ranges of values thereof, the first lock detection signal has a value within the first predetermined ranges of values thereof, and the second lock detection signal has a value within the third predetermined ranges of values thereof, the means for processing enabling the second output when the first point detection signal has a value within the second predetermined range of values thereof, the second point detection signal has a value within the fourth predetermined ranges of values thereof, the first lock detection signal has a value within the second predetermined ranges of values thereof, and the second lock detection signal has a value within the fourth predetermined ranges of values thereof, the means for processing disabling the first and second outputs when any of the first point detection signal has a value different than the first and second predetermined ranges of values thereof, the second point detection signal has a value different than the third and fourth predetermined ranges of values thereof, the first lock detection signal has a value different than the first and second predetermined ranges of values thereof, and the second lock detection signal has a value different than the third and fourth predetermined ranges of values thereof; and means for indicating the first and second outputs.

BRIEF DESCRIPTION OF THE DRAWINGS

A full understanding of the invention can be gained from the following description of the preferred embodiments when read in conjunction with the accompanying drawings in which:

FIG. 5 is a block diagram in schematic form showing two-wire control for a motor in accordance with an embodiment of the present invention.

FIG. 6 is a block diagram in schematic form of a circuit for monitoring a Namur sensor in accordance with an embodiment of the present invention.

DESCRIPTION OF THE PREFERRED EMBODIMENTS

Figure 1:
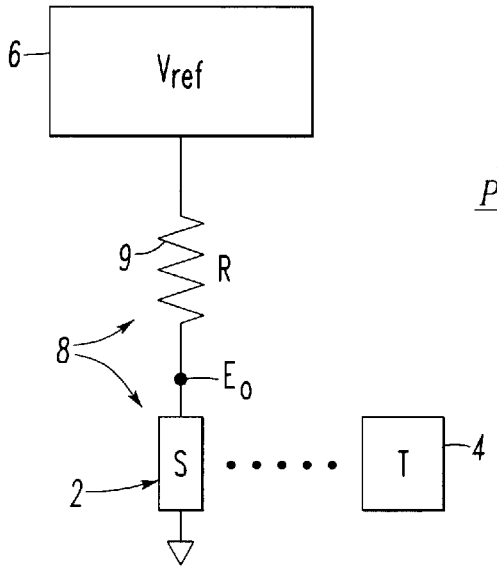
FIG. 1 PRIOR ART
FIG. 1 is a block diagram of a monitoring circuit for a Namur sensor.

Referring to FIG. 1, in an inductive proximity sensor, such as the exemplary Namur sensor (S) 2, a ferrite core (not shown) concentrates a magnetic field on a sensing end (not shown) of the sensor 2. When metal, such as a target (T) 4, is brought within sensing range, eddy currents are induced in the metal and act to dampen the oscillation load on an oscillator (not shown) of the sensor 2, thereby resulting in decreased current from a voltage source ($V_{ref}$) 6. Typically, the OFF current of the sensor 2 is about five to eight times greater than the ON current. As shown in FIG. 1, by employing the sensor 2 as a variable resistor in a voltage a divider 8 with a fixed resistor (R) 9, four possible sensor states, i.e., ON, OFF, shorted and open, may be resolved.

Figure 2:
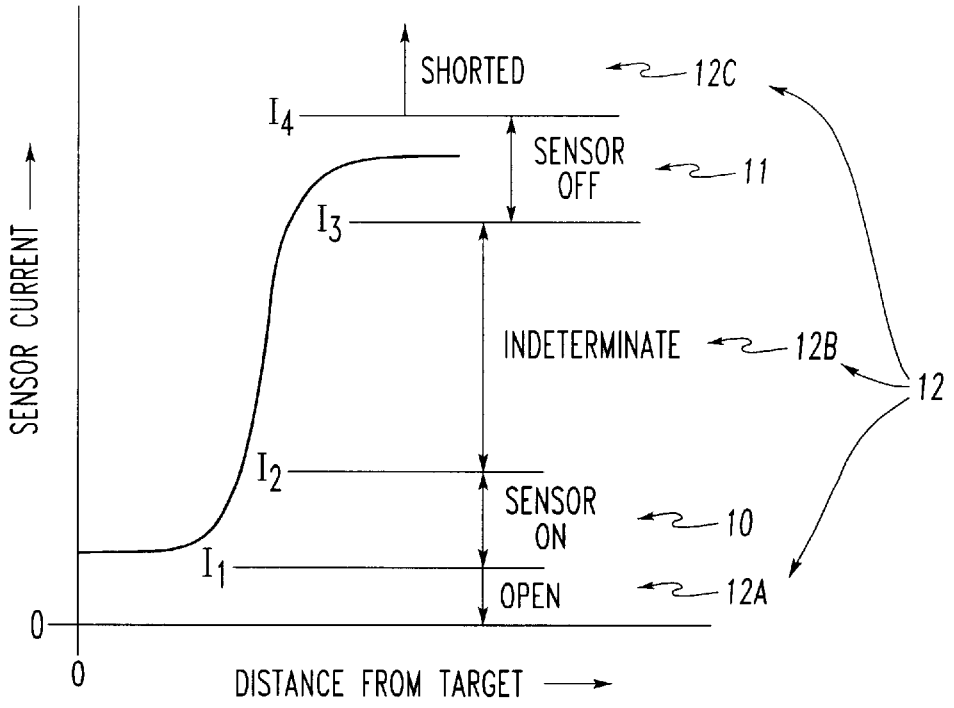
FIG. 2 PRIOR ART
FIG. 2 is a plot of sensor current versus distance from the target for the Namur sensor of FIG. 1.

FIG. 2 is a plot of sensor current versus distance from the target 4 for the Namur sensor 2 of FIG. 1. Three states for the sensor are defined to be ON 10, OFF 11, and indeterminate 12. If the sensor 2 does not return a current in the defined ranges 10 and 11 for being ON and OFF, respectively, then it is considered to be in the indeterminate state 12 (e.g., as defined by the three ranges 12A, 12B, 12C) and is operating marginally.

An inductive proximity sensor, such as 2, consists of a coil and ferrite core arrangement, and an oscillator (not shown). Other such inductive proximity sensors are three or four-wire devices. Many of these sensors have built in transistor(s) (not shown) that turn ON when the sensor is brought within close proximity to metal, such as target 4. A transition from OFF to ON occurs abruptly as the sensor is brought closer to the target and remains ON as the gap is further reduced to zero. The status of the transistor (i.e., ON or OFF) is the usual mechanism by which the status or distance to the metal target is determined. From a safety point of view, if close proximity to metal is to be acted upon as the more permissive state, then the saturated state of a transistor cannot be distinguished from its shorted condition. Thus, one cannot be sure that the apparent ON state of the transistor is the result of the sensor being in close proximity to metal or if the transistor is shorted. Conversely, if the transistor fails to an open state or if power is removed from the sensor, then the apparent OFF state of the transistor cannot be relied upon as truly indicating that the position of the sensor is out of metal detection range.

As shown below, the voltage ($E_o$) measured across the alternative sensor decreases progressively for each of the four states of shorted (Equation 1), within detection range (ON) (Equation 2), out of detection range (OFF) (Equation 3), and open (Equation 4).

$$E_o = 0 \quad \text{(Eq. 1)}$$

$$E_o = \frac{(V_{ref})}{(R + R_{on})}(R_{on}) \quad \text{(Eq. 2)}$$

$$E_o = \frac{(V_{ref})}{(R + 3R_{on})}(3R_{on}) \quad \text{(Eq. 3)}$$

-continued $$E_o = V_{ref} \quad \text{(Eq. 4)}$$

wherein:

$R_{on}$ is the resistance of the sensor in the ON state;

$3R_{on}$ is the resistance of the sensor in the OFF state; and $V_{ref}$ is the voltage of the voltage source.

Proximity sensors employed in railway signaling applications are generally rugged and very reliable. Various railroads also employ these sensors in drawbridge applications in order to set signals at a stop if the movable portion of the drawbridge is not properly positioned. Such sensors also ensure that railway switch points are touching or are sufficiently close to the stock rail in order to ensure safe is, passage of trains.

In the alternative embodiments, the status of the transistor is ignored in the three or four-wire devices. Instead, the sensor is treated as a two-wire device, which exhibits a distinctive impedance characteristic for each of the four states, i.e., ON, shorted, OFF and open.

Although Namur inductive proximity sensors are disclosed, the invention is applicable to any suitable plural-wire sensor device, which exhibits a significant decrease or increase in impedance when brought in close contact with a target. Again, however, there is a need to clearly distinguish, particularly between, shorted and ON and between open and OFF in safety critical applications. The present invention, thus, also applies to safely detecting the status of plural-wire inductive proximity sensors.

Figure 3:
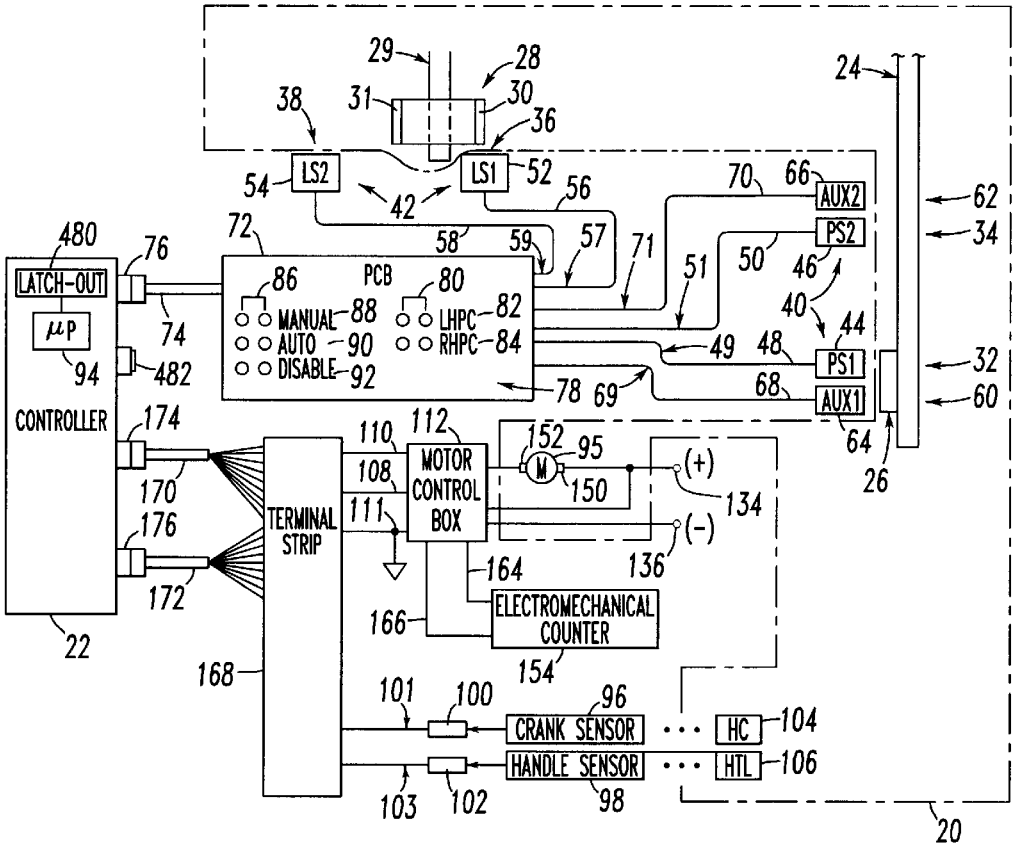
FIG. 3 is a block diagram in schematic form of a switch machine and an electronic controller with an embodiment of the present invention.

FIG. 3 shows a block diagram of a switch machine 20 and an electronic controller 22. Examples of a railway switch circuit controller, railroad switch machine gear box, and a point detection system for a switch machine are disclosed in U.S. Pat. Nos. 6,062,514; 6,138,959; and 6,186,448, respectively, which are incorporated by reference herein. The switch machine 20 includes an indication rod 24 having a target 26 and a lock box 28 having a lock rod 29 and two targets 30,31 on the sides of the box 28. The indication rod 24 is positionable between a first point position, as generally shown at 32 and defined by the target 26, and an opposite second point position, as generally shown at 34. The lock box 28 is positionable between a first lock position, as generally shown at 36, and a second lock position, as generally shown at 38. The position of the lock box 28 in FIG. 3 is defined by the target 30, which is at the position 36. The lock box 28 is movable to the left (with respect to FIG. 3) to the position 38 defined by the target 31 of the sensor 54.

The controller 22 includes a point detecting circuit 40 and a lock detecting circuit 42. The point detecting circuit 40 includes a first proximity sensor (PS1) 44 for detecting the indication rod target 26 when the indication rod 24 is in the first point position 32, and a second proximity sensor (PS2) 46 for detecting the indication rod target 26 when the indication rod 24 is in the second point position 34. In turn, the first proximity sensor 44 generates a first point detection signal 48 on conductor 49 and the second proximity sensor 46 generates a second point detection signal 50 on conductor 51. Although the sensors 44,46 are shown proximate the indication rod 24 (e.g., within the switch machine 20), such sensors may, alternatively, be placed on the track (not shown) to directly determine the proximity of the switch points to the rail (not shown).

In the exemplary embodiment, the sensors 44,46 sense the target 26. An adjustment (not shown) is provided within the machine 20 to move the sensors 44,46, in order that the target 26 is detected when the points are touching the stock rail (not shown) or within about a first distance (e.g., ¼ inch) of striking the stock rail. The sensors 52,54 are employed to detect the position of the targets 30,31, respectively, to prove that the switch machine 20 is mechanically locked in either of the two extreme lock positions 36,38, or else is between those positions as shown in FIG. 3.

A fundamental characteristic of these Namur sensors 44,46,52,54 is that they draw significantly less current when in close proximity to a metal target than when removed from close proximity to the target. Additionally, the transition which one might characterize as ON and OFF occurs abruptly. In the exemplary embodiment, proximity sensors having a nominal detection point of about 5 mm are preferably employed. The abrupt change of current that distinguishes ON from OFF occurs in an incremental change of position around the exemplary nominal detection point (e.g., 5 mm) of approximately 0.5 mm.

NAMUR inductive proximity sensors (e.g., marketed by Turck, Inc. of Minneapolis, Minn.; Pepperl & Fuchs of Twinsburg, Ohio) are preferably employed because the corresponding electronic circuitry is simpler and is believed to be more reliable than other forms of inductive proximity sensors. Alternatively, a wide range of inductive proximity sensors may be employed, which sensors draw more current when close to the target, and which are fitted with an indicator (e.g., LED) that illuminates when the target is in range. The ON/OFF current relationship of those other proximity sensors is opposite to that of the preferred NAMUR proximity sensors. Alternatively, other types of proximity sensors (e.g., Hall sensors) may be employed.

In the exemplary embodiment, the current drawn by the inductive proximity sensor, such as 44, is monitored through an analog-to-digital converter (ADC) 276 (FIG. 8) by the controller microprocessor ($\mu$P) 94. The $\mu$P 94 establishes a suitable range of monitored current in order to define the ON state and a suitable range of monitored current to define the OFF state, thereby distinguishing OFF from open and ON from shorted. Alternatively, if proximity sensors of a type where the ON current is more than the OFF current are employed, then it is also possible to distinguish ON from shorted and OFF from open. Any suitable sensor may be employed in which current detection and classification may be employed to distinguish four sensor states: ON, OFF, shorted and open, or three sensor states: ON, OFF, and indeterminate.

By employing an analog signal (e.g., at one of the corresponding inputs of the ADC 276 of FIG. 8) to define ON as being near the target and OFF as being away from the target, a range of current between ON and OFF is also established. This range is designated as being indeterminate. This indeterminate range is preferably established as an additional safeguard of subtle component failures within kits; the proximity sensor that could possibly cause an ON sensor to be interpreted as being OFF or an OFF sensor to be interpreted as being ON.

For example, for the PS1 sensor 44, the first point detection signal 48 is indeterminate of the first and second point positions 32,34 when that signal has a value which is less than (e.g., indeterminate range 12A of FIG. 2) the predetermined ON range of values (e.g., range 10 of FIG. 2), greater than the predetermined ON range of values but greater than (e.g., as shown by indeterminate range 12B of FIG. 2) the predetermined OFF range of values (e.g., range 11 of FIG. 2), or greater than (e.g., as shown by indeterminate range 12C of FIG. 2) the predetermined OFF range of values.

The lock detecting circuit 42 includes a first proximity sensor (LS1) 52 for detecting the lock box target 30 when the lock box 28 is in the first lock position 36 and a second proximity sensor (LS2) 54 for detecting the lock box target 31 when the lock box is in the second lock position 38. The first proximity sensor 52 of the lock detecting circuit 42 generates a first lock detection signal 56 on conductor 57 and the second proximity sensor 54 of the lock detecting circuit 42 generates a second lock detection signal 58 on conductor 59. The lock sensors LS1 52 and LS2 54 detect the extreme ends of mechanical motion and are employed by the UP 94 to separately provide indication and motor control.

The point detecting circuit 40 also includes a first auxiliary point sensor (AUX1) 64 for detecting the indication rod target 26 when the indication rod 24 is in a first auxiliary point position 60, and a second auxiliary point sensor (AUX2) 66 for detecting the indication rod target 26 when the indication rod 24 is in a second auxiliary point position 62. In turn, the sensor 64 generates a first auxiliary detection signal 68 on conductor 69 and the sensor 66 generates a second auxiliary detection signal 70 on conductor 71.

In the exemplary embodiment, nominally, the AUX1 and AUX2 sensors 64,66 indicate an ON state over a range of point closed to a gap of about ⅛ inch, whereas the PS1 and PS2 vital point sensors 44,46 indicate an ON state over a range of point closed to a gap of about ¼ inch. Operation of the sensors 64,66 is discussed below in connection with FIG. 9.

The six conductors 49,51,57,59,69,71 are routed to the controller 22 through ajunction box 72, cable 74 and connector 76. In this manner, the four exemplary Namur inductive proximity sensors PS1 44, PS2 46, LS1 52 and LS2 54 along with sensors AUX1 64 and AUX2 66 are terminated in the junction box 72. The junction box 72 includes a printed circuit board (PCB) 78 and a selection jumper 80 employed to designate one of the jumper positions LHPC 82 or RHPC 84 as being Normal. Another selection jumper 86 is employed to designate one of three "latch-out" operating modes of the controller 22: (1) Manual 88; (2) Auto 90; and (3) Disable 92. In turn, the status of the jumpers 80,86 are read by the $\mu$P 94 in the controller 22, in order to make the determination of RHPC or LHPC being Normal and the latch-out operating mode. Preferably, suitable logic is employed such that one, and only one, jumper (i.e., only one of RHPC 84 or LHPC 82) is installed. Otherwise, the indication outputs 224,230 (FIG. 7) are disabled. Hence, if the corresponding conductors (not shown) in the cable 74 between the junction box 72 and the controller 22 are shorted, then this too will negate the indication outputs.

Figure 4A:
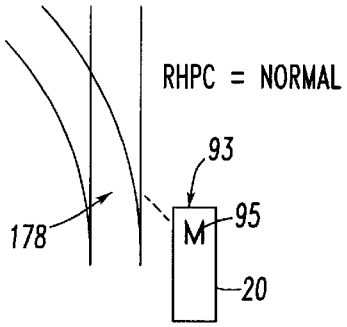
FIG.4A PRIOR ART
FIG. 4A is a block diagram of a switch machine and motor with respect to the track in which there is an assignment of right hand points closed (RHPC) being Normal.
Figure 4B:
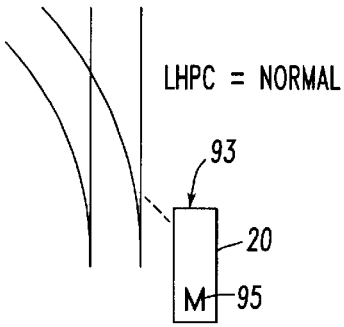
FIG.4B PRIOR ART
FIG. 4B is a block diagram of a switch machine and motor with respect to the track, in which there is an assignment of left hand points closed (LHPC) being Normal.

Referring to FIGS. 4A and 4B, in the exemplary embodiment, for purposes of illustration and not of limitation, the point of reference is looking toward the end 93 at the motor (M) 95 of the switch machine 20 in making the assignment of right hand points closed (RHPC) (FIG. 4A) or left hand points closed (LHPC) (FIG. 4B) to Normal. In the exemplary embodiment, the assignment of RHPC or LHPC to Normal is advantageously established by employing the jumper 80 of FIG. 3. This is an important advancement over the known prior art because, under field conditions with an installation crew working under pressure to restore operation if a switch machine, such as 20, is to be replaced, it requires less time and less skill to position a jumper, such as 80, than it takes to reconfigure a set of cams.

Referring again to FIG. 3, the controller 22 also includes a hand crank sensor 96 and a hand throw inductive proximity sensor 98 of the type discussed above in connection with Equations 1–4. Alternatively, Namur sensors may be employed. These sensors 96 and 98 output a HAND CRANK/ signal 100 on conductor 101, and a HAND THROW/ signal 102 on conductor 103, respectively. If the hand crank (HC) 104 of the switch machine 20 is activated or if the switch machine hand throw lever (HTL) 106 is moved to activate manual movement of the switch machine mechanism (not shown), then the corresponding sensor 96 or 98, respectively, switches to the off state, thereby providing a relatively low level of sensor current. In turn, the $\mu$P 94 provides the active low state of the corresponding one of the signals 100 or 102, respectively. The off state of either sensor 96,98 is also acted upon by the $\mu$P 94 to switch the motor control terminals 108,110 to 0 volts with respect to ground terminal 111, thereby effectively opening the motor circuit (FIG. 5) as provided by the motor control box 112. This prevents inadvertent activation of the motor 95 when the points are being moved by the hand crank 104 or by the hand throwlever 106.

FIG. 5 shows the motor circuit of the motor control box 112. In the event that the sensor LS1 52 of FIG. 3 is in the ON state and sensor LS2 54 is in the OFF state, the $\mu$P 94 senses those states and outputs a zero voltage on terminal (ON Motor Front corresponding to LS2) and a suitable positive voltage on terminal 108 (ON Motor Rear corresponding to LS1), with respect to the ground terminal Terminal 108 is electrically connected through resistor 114 to the input 115 of optically coupled gate controller 116, which provides isolation between the controller 22 and the motor voltage. In turn, the outputs 117,118 (two outputs are employed in the exemplary embodiment to provide a more positive turn on of the MOSFETs) of the gate controller 116 are electrically connected to the gate 120 of N-channel MOSFET transistor 122. Similarly, terminal 110 is electrically connected through resistor 124 to the input 125 of gate controller 126. In turn, the outputs 127,128 of the gate controller 126 are electrically connected to the gate 130 of N-channel MOSFET transistor 132. In this example, with terminal 108 being at a positive voltage, transistor 122 is turned on.

The transistors 122,132 act as efficient bilateral switches when the corresponding gate is made positive relative to the source (i.e., they conduct with equal efficiency for current of either polarity). They also conduct when the gate voltage is off, but only in the direction as dictated by the MOSFET body diodes 142,143 from source to drain. When current is sustained through one of those body diodes, the voltage drop from source to drain is approximately 0.7 volts. However, when the gate voltage is present, the transistors 122,132 conduct for either polarity with a much smaller voltage drop.

A suitable voltage (e.g., 24 VDC, 110 VDC) is applied between the terminals 134,136 from a wayside control circuit (not shown). In turn, current passes from the terminal 134 through the motor 95 (from left to right in FIG. 5), through the drain 138 to the source 140 of transistor 122 (which is turned on in this example), and through the body diode 142 of transistor 132 (which is turned off in this example) and back to the terminal 136. As switch machine motion begins, sensor LS1 52 assumes the OFF state and terminal 110 switches to a positive voltage, which is sufficient to turn transistor 132 on through gate controller 126. Through most of the mechanical movement within the machine 20, both transistors 122,132 remain on Thus, at any intermediate portion of the total stroke, it is possible to reverse direction. At the end of the normal stroke, sensor LS2 54 changes state to ON, and terminal 108 switches to 0 volts, thereby turning transistor 122 off, which interrupts motor current. At this point, the voltage applied to terminals 134,136 appears across transistor 122 with the drain 138 being positive relative to the source 140. This turns the solid state relay (SSR) triac 146 on through diode 147 and essentially connects resistor 148 across the terminals 150, 152 of the motor 95. In turn, the stored energy of the motor 95 now acting as a generator, is dissipated in resistor 148, which brings the motor 95 quickly to a stop by employing dynamic braking. Dynamic braking reduces the variation of the machine stopping point, which is no longer influenced appreciably by lubricant viscosity, friction and inertia.

Reverse motion of the switch machine 20 is achieved with the opposite polarity on the terminals 134,136, and the roles of transistors 122,132 are reversed in switching action. There is, however, one difference, namely, at the end of stroke, the positive voltage across transistor 132 initiates dynamic braking in addition to advantageously energizing the electromechanical counter 154. At the end of the reverse stroke, sensor LS1 52 changes state to ON, and terminal 110 switches to 0 volts, thereby turning transistor 132 off, which interrupts motor current. At this point, the voltage applied to terminals 136,134 appears across transistor 132 with the drain 156 being positive relative to the source 158. This turns the SSR triac 146 on through diode 160 and essentially connects resistor 148 across the motor terminals 150,152. That same positive voltage is applied through the resistor 162 and the terminals 164,166 in order to energize and advance the electromechanical counter 154. It is useful to employ the counter 154 because the number of cycles the switch machine 20 has encountered is far more important in determining maintenance than the number of years of service.

Figure 11:
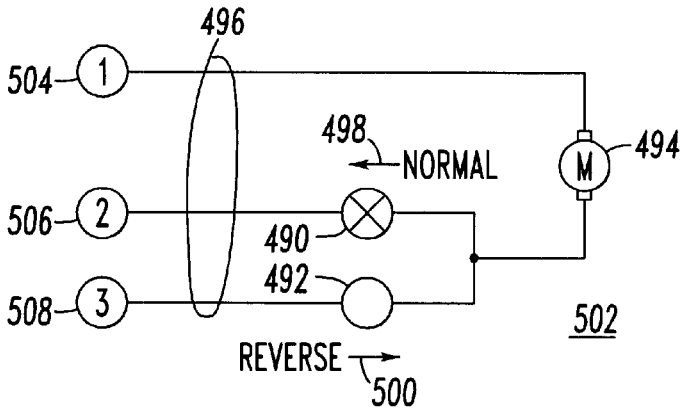
FIG. 11 PRIOR ART
FIG. 11 is a block diagram in schematic form showing three-wire control for a motor.

Although exemplary two-wire (i.e., at 134 and 136) motor control is shown in FIG. 5, three-wire control (as shown in FIG. 11) using a suitable configuration of the circuit elements of FIG. 5 may alternatively be employed. Two-wire control saves wiring costs. In applications where the exemplary switch machine 20 replaces an older switch machine, one of the existing wires (e.g., 506 and 508 of FIG. 11) may be connected in parallel in order to reduce voltage drop and, thus, provide better performance of the machine.

The exemplary switch machine 20 provides motor control employing the transistors 122,132 having polarity sensitive conductivity when OFF, and a circuit (e.g., outputs of $\mu$P 94 to drive terminals 108,110 through buffers (not shown)) activated from proximity sensors 44,46,52,54 to start and stop the motor 95 in conjunction with a dynamic brake formed by SSR 146 and resistor 148, thereby offering an improved form of control over that provided by mechanical switches.

As shown in FIG. 3, the conductors 101,103 and the terminals 108,110,111 are electrically connected to the controller 22 through a terminal strip 168, cables 170,172 and connectors 174,176.

In accordance with the present invention, if any one (or more) of the four exemplary Namur sensors 44,46,52,54 is operating in an indeterminate state, then the output signals 382,388,394 (as discussed below in connection with FIG. 9) from the controller 22 to the railroad signaling system (not shown) are dropped, thereby indicating a possible problem such that no rail traffic should pass over the corresponding switch (e.g., 178 of FIG. 4A). In the exemplary embodiment, point detection for the railway switch machine 20 safely determines the sensor ON state, because it is reflected in the signal system as a permissive state permitting safe passage of a train. In other words, it would be unsafe if the OFF, shorted or open states of one of the sensors 44,46,52,54 were misinterpreted with the ON state because that would lead to an unwarranted permissive state reflected by the signal system.

Various techniques may be employed to uniquely detect the sensor ON state in the exemplary embodiment, in which the Namur sensors 44,46,52,54 draw more current in the OFF state than in the ON state. For example, more current is drawn if the unit is shorted and it is, thus, possible to distinguish OFF for safety critical applications. One mechanism by which the sensor ON state can be uniquely distinguished and, thus, relied upon for making safety critical logic decisions is shown in FIG. 6.

Three voltage reference sources 180,182,184 provide suitable reference voltages V1,V2,V3, respectively, and are employed to ensure the integrity of the analog to digital converter (ADC) 186, in order that the ON state of the Namur sensor 188 can be distinguished from the shorted, OFF or open states. A microcomputer ($\mu$C) 190 employs a priori data, in digital form, as to the value of each of the reference voltages V1,V2,V3. The $\mu$C firmware 192 safely determines the state of the sensor 188 by testing the voltage source (V1) 180, which powers the sensor 188 through resistor 189, and by suitable calibration (not shown) of the ADC 186. The $\mu$C firmware 192 sets the two digital outputs 194 to a suitable state (e.g., 01) to select , input 196 of 4:1 analog multiplexer 198, and measures the selected voltage V1 at the digital input 199 as converted by the ADC 186 from the multiplexer output 197. The $\mu$C firmware 192 employs this reading to ensure that the sensor source voltage is within tolerance. Then, the $\mu$C firmware 192 sets the two digital outputs 194 to a suitable state (e.g., 00) to select multiplexer input 200, and measures the selected voltage $E_o$ through the multiplexer output 201 and the ADC 186. In this manner, the sensor $E_o$ measurement truly reflects the status of the sensor 188 and is not falsely reported because the voltage V1 might have changed.

Similarly, the $\mu$C firmware 192 sequentially sets the two digital outputs 194 to suitable states (e.g., 10 and 11) to select multiplexer inputs 202 and 204, and measures the selected voltages V2 and V3 through the multiplexer outputs 203 and 205, respectively, and the ADC 186. The voltages V2 and V3 are set to suitably match the desired output range for the sensor ON state. These measurements ensure that the ADC 186 and firmware 192 respond correctly for the critical range corresponding to the sensor ON state. That is, for a suitable voltage V1, the sensor ON state voltage $E_o$ is between the predetermined limits V2 and V3. Preferably, for vitality of measurements, and simultaneous with periodic measurements of $E_o$, a window comparator 206 has an input 207 electrically connected to the output of the sensor 188. The output 208 of the comparator 206 is active whenever the input voltage Eo is between the reference voltages V2 and V3. Hence, the comparator 206 feeds a digital value which is active for the sensor ON state, and which is inactive for any of the sensor OFF, shorted, open or indeterminate states to the $\mu$C input 210, in order to provide an independent confirmation that the voltage $E_o$ is being measured. This ensures that the multiplexer 198 has indeed fed $E_o$ to the ADC 186, rather than one of the voltages V1, V2 or V3. Since the voltages V2 and V3 are in the acceptable range of output voltages from the sensor 188 for the ON state, it is safety critical to avoid misinterpretation that either of the measurements of V2 or V3 is of $E_o$. This is avoided through the $\mu$C firmware 192, which ensures that the ADC measurement of $E_o$ is contemporaneous with the corresponding window comparator response for $E_o$. For all other measurements of V1, V2 and V3, the window comparator output 208 is ignored. It will be appreciated that two additional voltages (not shown) and a further window comparator (not shown) may be employed for suitable detection of the sensor OFF state.

As an important aspect of the invention, a signal corresponding to the sensors PS1 44 or PS2 46 of FIG. 3, is true (e.g., high) for only the sensor ON state, and is false (e.g., low) for any of the other possible states (e.g., sensor shorted; indeterminate; sensor OFF; sensor open). For convenience of reference, the signals corresponding to the sensor signals 48 and 50 are referred hereinafter to PS1 and PS2, respectively. It will be appreciated that other equivalent embodiments might employ reverse logic, such as false (e.g., low) for only the sensor ON state, and true (e.g., high) for any of the other possible sensor states. Similarly, a related signal, such as PS1/ or PS2/, is false (e.g. high) for only the sensor OFF state, and is true (e.g., low) for any of the other possible states (e.g., sensor shorted; indeterminate; sensor ON; sensor open).

Figure 7:
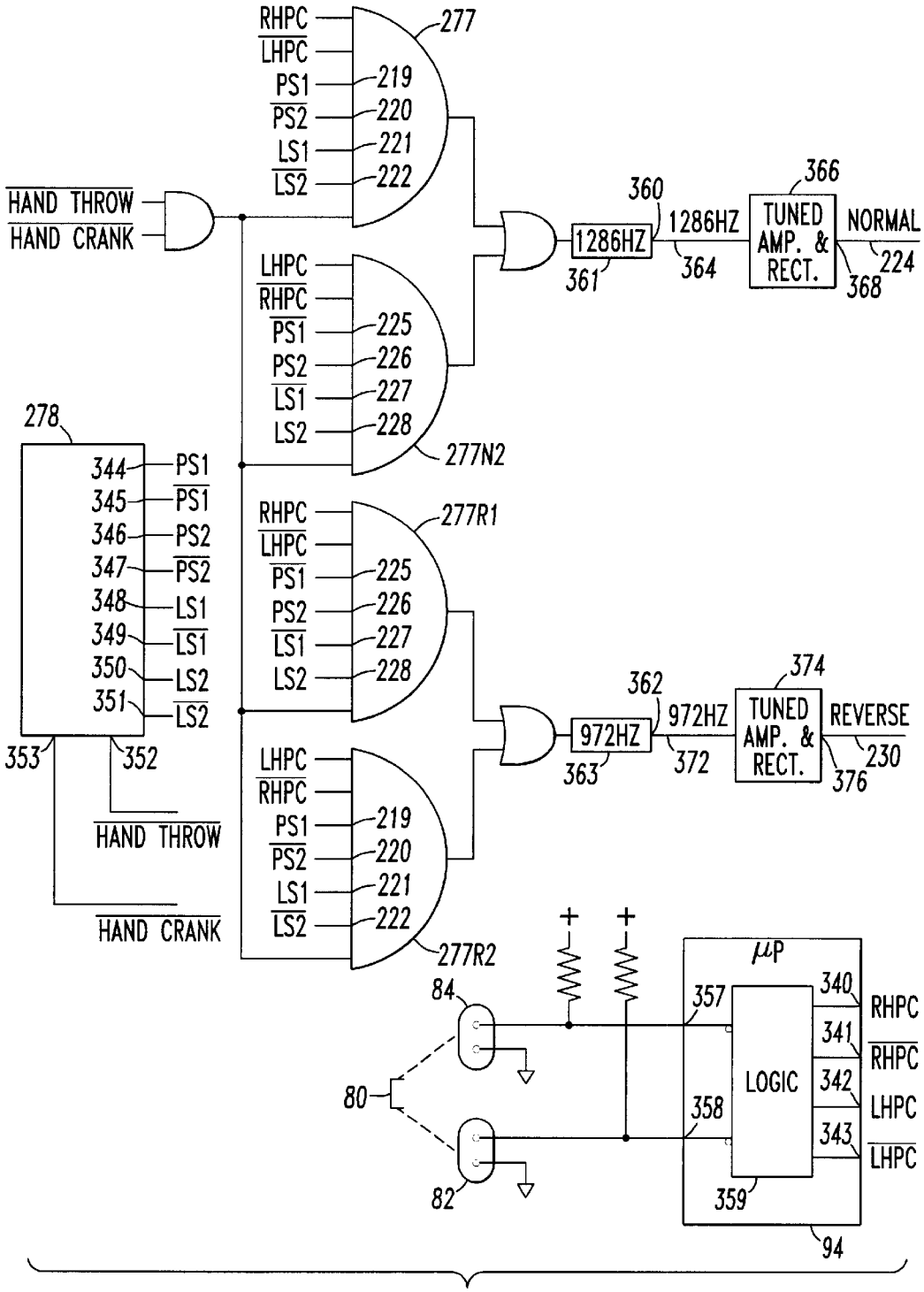
FIG. 7 is a block diagram in schematic form of logic governing Normal and Reverse indication circuits for the electronic controller of FIG. 3.

Referring to FIG. 7, an enable signal, such as PS1 219, only enables for sensor ON, and another enable signal, such as PS2/ 220, only enables when the corresponding sensor is OFF. In other words, as will be apparent from the logic of AND gate 277, if any of the PS1 signal 219, the PS2/ signal 220, the LS1 signal 221 or the LS2/ signal 222 have a shorted, indeterminate or open state, then (if AND gate 277N2 is not active) the corresponding NORMAL output 224 is false. Similar logic (AND gate 277R1) is also provided such that if any of the PS1/ signal 225, the PS2 signal 226, the LS1/ signal 227, or the LS2 signal 228 have a shorted, indeterminate or open state, then (if AND gate 277R2 is not active) the corresponding REVERSE output 230 is false. In this manner, the NORMAL and REVERSE outputs 224,230 of the machine 20 are both false (i.e., have a fail-safe state).

Figure 8:
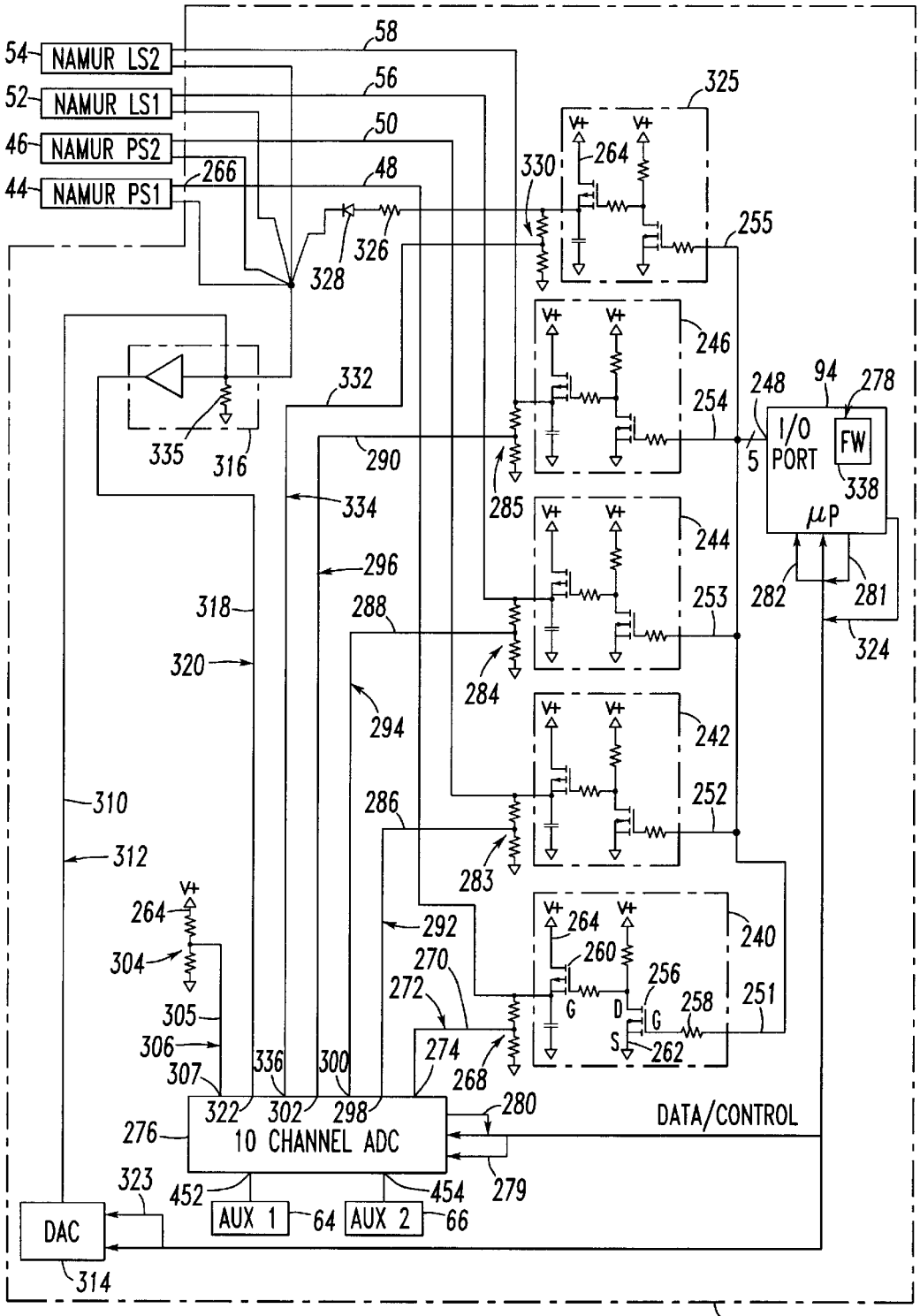
FIG. 8 is a block diagram in schematic form of a circuit for monitoring the Namur sensors of FIG. 3 in accordance with another embodiment of the present invention.

FIG. 8 shows another fail-safe technique to uniquely detect the sensor ON state of the Namur sensors PS1 44, PS2 46, LS1 52, LS2 54, which sense the positions of mechanical parts inside of the railroad switch machine 20 of FIG. 3. These sensors 44,46,52,54 are part of the electronic circuit controller (ECC) 22 of FIG. 3, which monitors the switch machine state and reports indication outputs to the railroad signaling system (not shown). Correct operation of those sensors is critical to the safe usage of the switch machine 20. In order to monitor the sensors 44,46,52,54, each sensor has a corresponding power source 240,242,244,246, respectively, which is individually switched on in a mutually exclusive manner. This is accomplished through the I/O port 248 of the $\mu$P 94, which port has five digital outputs 251,252,253,254,255.

As an example, the $\mu$P 94 activates the sensor 44 through the power source 240. The $\mu$P 94 places a logical one (e.g., +5 VDC) on the port output 251 which controls the gate of MOSFET transistor 256 through resistor 258. In turn, the transistor 256 turns on and creates a suitably low impedance between its drain and source terminals. This effectively pulls the gate of P-Channel transistor 260 to ground 262, which creates a suitably low impedance between the source and drain of transistor 260, in order to provide the voltage V+264 to the power feed input 266 of Namur sensor 44.

The sensors 46,52,54 are switched on through the $\mu$P port outputs 252,253,254 and the power sources 242,244,246, respectively, in a similar manner. After the sensor 44 is switched on, the V+ voltage 264 to the sensor's power feed 266 is also placed across a resistor divider 268 which creates a unique "signature" voltage 270 on conductor 272 associated with that sensor 44. The conductor 272 is electrically connected to an analog input 274 of the N-channel (e.g., 10 channels, of which only 9 are shown) ADC 276. As discussed below, the firmware 278 of the $\mu$P 94 checks that the signature voltage 270 is associated with the proper ADC channel 274, and is within a unique predetermined voltage range associated with the sensor 44.

The ADC 276 includes four digital inputs 279 to select one of the 10 exemplary analog input channels, and a plural-bit digital output 280 having a value. The μP 94 has four digital outputs 281 to drive and control the ADC digital inputs 279, and a plural-bit data bus 282 to read the value from the ADC digital output 280. The μP 94 also has the digital outputs 251–255 on the I/O port 248 to enable or disable a corresponding one of the power sources 240,242, 244,246,325, and the firmware 278 to read the ADC value from the data bus 282.

Similarly, the other power sources 242,244,246 have dividers 283,284,285 which create unique "signature" voltages 286,288,290 on conductors 292,294,296 for the other sensors 46,52,54 and other ADC channels 298,300,302, respectively. Preferably, those other sensor signature voltages 286,288,290 are checked to be off or at 0V before it is determined that the sensor 44 was switched on The firmware 278 time slices the switching of the sensors 44,46,52,54, and performs diagnostic analysis and other suitable functions. Several diagnostic tests are preferably performed to assess the performance of the hardware associated with those sensors before each sensor reading. First, the power source V+ 264 is fed to a resistor divider 304 the unique output voltage 305 of which is fed through conductor 306 to a corresponding ADC channel 307. The firmware 278 reads the corresponding digital value from the ADC 276 and determines that it is within a predefined range. The firmware 278 reads the ADC digital output 280 corresponding to the analog input 307 (e.g., 1.5 VDC) to determine if that value is within a predetermined value (e.g., 0.2+/−0.02 VDC) of the unique voltage value. Otherwise, an error condition occurs and the indicator outputs from the controller 22 to the railroad signaling system are dropped.

Next, a voltage 310 is suitably ramped up (e.g., a plurality of voltage values such as, for example, without limitation, 0 VDC, 1 VDC, 2 VDC, 3 VDC, 4 VDC) on the analog output 312 of a digital to analog converter (DAC) and fed directly into the input signal conditioning circuitry 316. During this time, the sensor power sources 240,242,244,246,325 are turned off. After each voltage step is fed into the input signal conditioning circuitry 316, the corresponding output voltage 318 on conductor 320 is input to the ADC channel 322. The firmware 278 reads the corresponding digital value from the ADC 276 and determines that it is within predetermined limits to check the linearity of the input circuitry 316 and the ADC 276. The DAC 314 has a digital input 323. The ADC analog input 322 is electrically interconnected with the DAC analog output 312 through the input signal conditioning circuitry 316. The UP 94 has a digital output 324 electrically interconnected with the DAC digital input 323 to output one of the predetermined set of values thereto. The μP firmware 278 reads the corresponding ADC digital output 280 to determine if that value is within a predetermined value (e.g., +/−0.1 VDC) of each one of the predetermined set of values. If any one of the ramped input levels fails to be within the corresponding limits, then an error condition occurs and the outputs from the controller 22 to the railroad signaling system are dropped.

As a further check of the hardware before the actual Namur sensors 44,46,52,54 are read, a virtual sensor, which is formed by power source 325, resistor 326 and diode 328, is switched on. Similar to the other power sources 240,242, 244,246 for the actual Namur sensors, a resistor divider 330 produces a unique signature voltage 332 on conductor 334. That signature voltage 332 is fed to the ADC channel 336 in order that the μP firmware 278 can determine that the virtual sensor is on and that the actual Namur sensors 44,46,52,54 are off. The voltage V+ 264 is fed over the input resistor 335 and produces a known voltage due to the resistors 326,335 and diode 328. After the virtual sensor is determined to be on, the voltage 318 is checked to be within predetermined limits. Otherwise, an error condition occurs and the indicator outputs from the controller 22 to the railroad signaling system are dropped.

Unique signature voltages are provided by the dividers 268, 283, 284, 285, 304 and 330. The predetermined range of values for the PS1,PS2,LS1,LS2 signals 48,50,56,58 being ON are preferably the same, and the predetermined range of values for the PS1,PS2,LS1,LS2 signals being OFF are preferably the same, although different ranges of values may be employed for the different sensors (e.g., in order to account for manufacturing variations between such sensors).

If the exemplary hardware checks are completed successfully, then the μP firmware 278 sequentially enables one of the power sources 240,242,244,246, sequentially reads the Namur sensor signals 48,50,56,58 through the ADC channel 322, with those readings being accepted as being valid. In the exemplary embodiment, each Namur sensor is independently switched on and is read about 10 ms later, thereby allowing the ADC channel input to suitably settle. For example, if the value of the Namur sensor signal 48 is within a predetermined ON range, then the signal PS1 219 of FIG. 7 is deemed high true (enable), otherwise the signal PS1 219 is deemed false (disable). Also, if the value of the Namur sensor signal 50 is within a predetermined OFF range, then the signal PS2/ 220 of FIG. 7 is deemed high (enable), otherwise the signal PS2/ 220 is deemed low (disable).

For the example shown in FIG. 7, two pairs of sensor signals are defined (e.g., the pair PS1, LS1 and the pair PS2/, LS2/ of AND gate 277). In order to provide the NORMAL output 224 from the first AND gate 277, the pair PS1, LS1 must both be high true (i.e., within the predetermined ON range) and the pair PS2/, LS2/ must both be (high) false (i.e., within the predetermined OFF range), in order for the controller 22 to deliver that output to the railroad signaling system. Similarly, in order to provide the REVERSE output 230 from the third AND gate 277R1, the pair PS2, LS2 must both be high true (i.e., within the predetermined ON range) and the pair PS1/, LS1/ must both be (high) false (i.e., within the predetermined OFF range), in order for the controller 22 to deliver that output to the railroad signaling system. The firmware 278 includes a subroutine 338 of FIG. 8 which: (1) reads the ADC value from the data bus 282 corresponding to each of the proximity sensors 44,46,52,54; (2) reads the ADC value from the data bus 282 corresponding to each of the dividers 268,283, 284,285, 330; and (3) determines if each of the divider values is within a predetermined value of a corresponding one of the unique voltages. For example, the value of the divider 268 may nominally be set at about 1.5 VDC with the corresponding range of values set at about 0.2+/−0.2 VDC, while the value of the divider 283 may nominally be set at about 2.2 VDC with the corresponding range of values set at about 0.2+/−0.2 VDC. As an additional diagnostic check, after the firmware 278 reads the ADC value from the data bus 282 corresponding to one of the proximity sensors 44,46,52,54, the ADC values from the data bus 282 corresponding to the other proximity sensors 44,46,52,54 are read and a check is made to ensure that those other values are all within a predetermined value of zero (e.g., about 0.0+/−0.2 VDC), in order to determine that the other proximity sensors were all disabled.

Referring again to FIG. 7, the IMP firmware 278 includes digital outputs 340–353 for the RHPC, RHPC/, LHPC, LHPC/, PS1 219, PS1/ 225, PS2 226, PS2/ 220, LS1 221, LS1/ 227, LS2 228, LS2/ 222, HAND THROW/ and HAND CRANK/ signals, respectively. As discussed above, if PS1 219 is low, then PS1/ 225 is NOT correspondingly high in all cases. In fact, for the shorted and the open sensor states and for the range of sensor current that is between the predefined range of ON values and the predefined range of OFF values, then both PS1 219 and PS1/ 225 are low. To further explain: the ON and OFF states carry equal weight in the logic and each state is uniquely and independently defined. The ON state is defined from a predefined window of sensor current which is lower than the predefined window of current for the sensor OFF state. The current from zero to the lower boundary of the ON window or state, the current between the upper boundary of the ON state and the lower boundary of the OFF state, and the current above the upper boundary of the OFF state are logically defined as neither ON or OFF (i.e., indeterminate).

Thus, the signal PS1 219 is high for only the sensor ON state, and is low for any one of the sensor shorted, open, indeterminate or OFF states. A related signal, such as PS1/ 225, is low for any one of the sensor shorted, open, indeterminate or ON states, and is high for only the sensor OFF state. Hence, an enable signal, such as PS1 219, only enables for sensor ON, and another enable signal, such as PS2/ 220, only enables (and does NOT disable) when the corresponding sensor is OFF. In other words, if any of the PS1, PS2, LS1, LS2 sensors 44,46,52,54 have a shorted, open or indeterminate state, then the NORMAL and REVERSE outputs 224,230 are both false.

As shown in FIG. 7, the exemplary AND gate 277 illustrates the logic implemented by the $\mu$P firmware 278 in establishing the Normal output 224 for RHPC being defined as Normal. The exemplary AND gate 277 employs seven inputs, although any suitable logic function may be employed. First, the RHPC output 340 being true indicates a selection based upon orientation of the switch machine 20 to the tracks and the intention to establish RHPC as the Normal output (FIG. 4A). Second, the LHPC/ output 343 (i.e., negation of LHPC 342) ensures that one, and only one, of the LHPC and RHPC jumpers 82,84 (FIG. 3) is selected. Thus, for the seven inputs, Normal is established if PS1 219 and LS1 221 are both ON, PS2/ 220 and LS2/ 222 are both OFF, RHPC is selected, LHPC is not selected (i.e., LHPC/ 343 is high), and neither HAND THROW/ nor HAND CRANK/ is activated.

The NORMAL indication output 224 (and the REVERSE indication output 230) are interrupted when hand operation (i.e., HAND THROW/ or HAND CRANK/ is activated). For the AND gates 277N2,277R1,277R2, other combinations (e.g., NORMAL with LHPC selected; REVERSE with RHPC selected; REVERSE with LHPC selected) also result in the activation or interruption of the corresponding indication outputs 224,230.

In the prior art, sensor status was verified dynamically (i.e., by verifying that all of the PS1, PS2, LS1 and LS2 sensors have changed ON and/or OFF states), but not statically. Thus, for example, a sensor, once proven to be ON, could short and go undetected until the machine was cycled from Normal to Reverse or from Reverse to Normal. In the exemplary embodiment, the ability to distinguish sensor ON and OFF from sensor shorted and open, and the further refinement to assign a predetermined range of current for each logic state, guard against failures of a sensor that mask its true logic state of ON or OFF.

As shown in FIG. 7, the logic for the NORMAL output 224 and the REVERSE output 230 preferably ensures that the HAND THROW/ and HAND CRANK/ signals are both false in response to the sensors 96,98 of FIG. 3 being inactive. For the NORMAL output 224 and the REVERSE output 230, the logic also preferably ensures that the jumper 80 of FIG. 3 is in the RHPC 84 position (i.e., RHPC is high) and is not in the LHPC 82 position (i.e., LHPC/ is high). From AND gate 277, the NORMAL output 224 is set true for the combination of high signals RHPC, LHPC/, PS1, PS2/, LS1, LS2/, HAND THROW/ and HAND CRANK/. From AND gate 277R1, the REVERSE output 230 is set true for the combination of high signals RHPC, LHPC/, PS1/, PS2, LS1/, LS2, HAND THROW/ and HAND CRANK/.

Alternatively, if the jumper 80 of FIG. 3 is in the LHPC 82 position (i.e., LHPC is high) and is not in the RHPC 84 position (i.e., RHPC/ is high), the NORMAL output 224 is set true from the AND gate 277N2 for the combination of high signals LHPC, RHPC/, PS1/, PS2, LS1/, LS2, HAND THROW/ and HAND CRANK/. From the AND gate 277R2, the REVERSE output 230 is set true for the combination of high signals LHPC, RHPC/, PS1, PS2/, LS1, LS2/, HAND THROW/ and HAND CRANK/.

As shown in FIG. 7, the $\mu$P 94 has two digital inputs 357,358, which input the RHPC 84 and LHPC 82 jumper selectors of FIG. 3 for firmware logic 359. The logic 359 functions as shown in Table 1:

TABLE 1

| JUMPER 84 | JUMPER 82 | RHPC | RHPC/ | LHPC | LHPC/ |
|---|---|---|---|---|---|
| not selected | not selected | 0 | 1 | 0 | 1 |
| not selected | selected | 0 | 1 | 1 | 0 |
| selected | not selected | 1 | 0 | 0 | 1 |
| selected | selected | 0 | 1 | 0 | 1 |

Hence, through jumper 80 RHPC is selected when selector 84, and only selector 84, is selected, and LHPC is selected when selector 82, and only selector 82, is selected.

In accordance with a preferred practice of the invention, the $\mu$P 94 has a first output 360 driven by a 1286 Hz frequency function 361, which corresponds to the NORMAL output 224, and a second output 362 driven by a 972 Hz frequency function 363, which corresponds to the REVERSE output 230. As discussed below in connection with FIG. 9, the first output 360 has an exemplary 1286 Hz signal 364 whenever the logic determines that the NORMAL output 224 should be active (e.g., as set by one of AND gate 277 or AND gate 277N2). A tuned amplifier and rectifier 366 inputs and detects the exemplary 1286 Hz signal 364 and responsively outputs, at 368, the NORMAL output 224. However, a DC signal or an AC signal having a suitably different frequency results in the NORMAL output 224 being inactive. The tuned amplifier and rectifier 366 is suitably narrowly tuned to 1286 Hz and amplifies and rectifies the filtered signal to produce a suitable DC voltage in order to indicate that all conditions for a Normal output are fulfilled. Similarly, the second output 362 has an exemplary 972 Hz signal 372 whenever the logic determines that the REVERSE output 230 should be active. A tuned amplifier and rectifier 374 inputs and detects the exemplary 972 Hz signal 372 and responsively outputs, at 376, the REVERSE output 230.

It will be appreciated that a wide range of different frequencies may be employed. The exemplary frequencies (972 Hz and 1286 Hz) provide a suitable frequency separation, which is sufficient to avoid amplification through the wrong channel.

Figure 9:
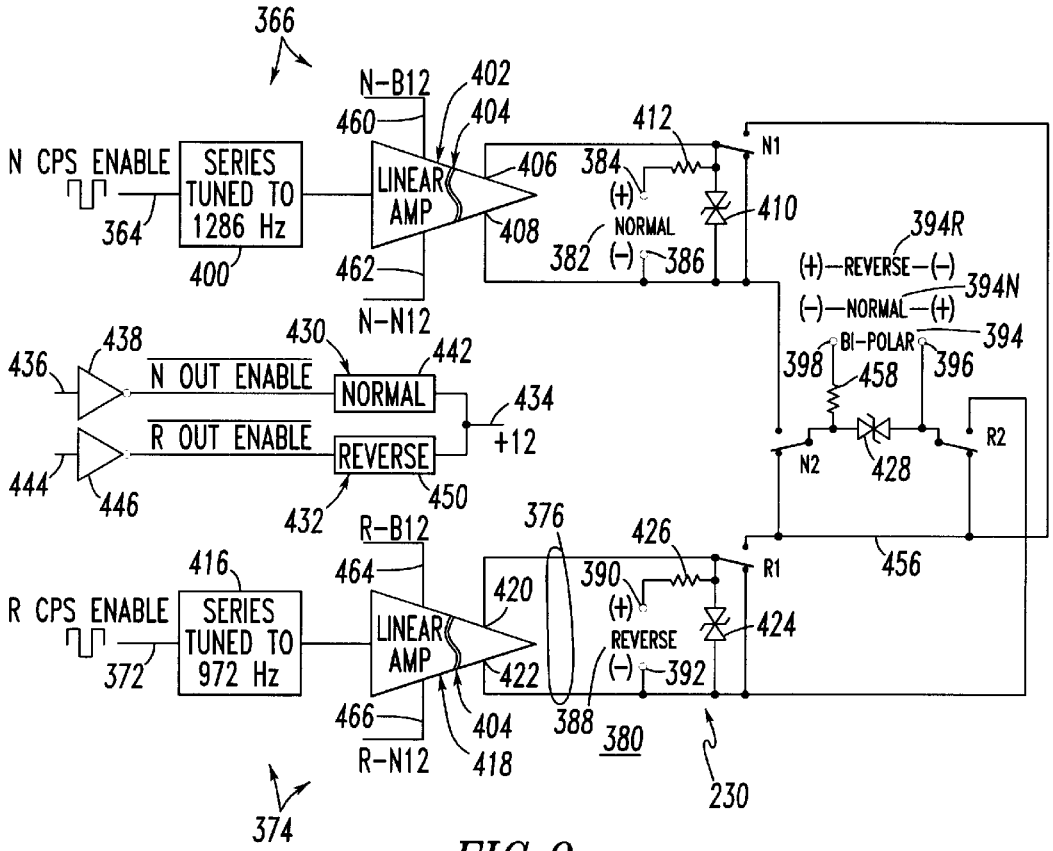
FIG. 9 is a block diagram in schematic form of the indication circuits for the electronic controller FIG. 3.

FIG. 9 shows indication circuitry 380 associated with the N CPS (Conditional Power Supply) ENABLE signal 364 and the R CPS ENABLE signal 372 of FIG. 7. Indication of the switch machine status (e.g., Normal or Reverse in the exemplary embodiment) takes the form of two separate independent DC voltages: (1) Normal 382 at terminals 384,386; and (2) Reverse 388 at terminals 390,392. The exemplary embodiment also includes a bipolar DC output 394 in which Normal 394N has a positive voltage between terminals 396 and 398, and Reverse 394R has a positive voltage between terminals 398 and 396. This advantageously gives the user the option of using two independent two-wire output signals 382,388, or a single two-wire bipolar indication output signal 394.

The Normal tuned amplifier and rectifier 366 includes a suitable bandpass filter circuit 400 which is series tuned to the exemplary 1286 Hz frequency of the N CPS ENABLE signal 364. The narrowly tuned filter circuit 400 is included in the output path in order to guard against the possibility of the $\mu$P 94 or other circuitry malfunctioning in a spurious oscillation, which might otherwise be amplified, rectified and delivered as a false output. In turn, the bandpass circuit 400 feeds a linear amplifier 402 having a transformer isolation circuit 404 for outputs 406,408, which are protected by metal oxide varistor (MOV) 410. The linear amplifier 402 boosts power, provides isolation through the transformer circuit 404, and provides the rectified outputs 406,408 in response to an input delivered from the series tuned circuit 400. Presence of the N CPS ENABLE signal 364 results in a positive voltage at output 406 with respect to output 408, which in turn provides the Normal signal 382 through resistor 412. The normal and reverse channels are identical except for the tuning elements 400,416 to discriminate 1286 Hz from 972 Hz.

Similarly, the Reverse tuned amplifier and rectifier 374 includes a suitable bandpass circuit 416 which is series tuned to the exemplary 972 Hz frequency of the R CPS ENABLE signal 372. In turn, the bandpass circuit 416 feeds a linear amplifier 418 having an isolation circuit 404 for outputs 420,422, which are protected by MOV 424. Presence of the R CPS ENABLE signal 372, results in a positive voltage at output 420 with respect to output 422, which in turn provides the Reverse signal 388 through resistor 426.

The bipolar DC output 394, which is protected by MOV 428, follows the Normal and Reverse signals 382,388. The bipolar DC output 394 and the Normal and Reverse signals 382,388 are also controlled by a normal relay 430 and a reverse relay 432, as discussed below. The normal relay 430 is energized from an exemplary +12 VDC power source 434 whenever a digital output 436 of $\mu$P 94 is active. That output 436 is inverted by inverting buffer 438 to provide a N OUT ENABLE/signal 440 to energize the coil 442 of the relay 430. Similarly, the reverse relay 432 is energized from the +12 VDC power source 434 whenever a $\mu$P digital output 444 is active. That output 444 is inverted by inverting buffer 446 to provide a R OUT ENABLE/signal 448 to energize the coil 450 of the relay 432.

Generally, the active state of the $\mu$P output 436 corresponds to the active state of the 1286 Hz signal 364, and the active state of the $\mu$P output 444 corresponds to the active state of the 972 Hz signal 372. However, the $\mu$P firmware 278 of FIG. 8 also monitors the ON/OFF state of the AUX1 sensor 64 through ADC channel 452, and the ON/OFF state of the AUX2 sensor 66 through ADC channel 454. In brief, the active state of the output 436 indicates that the Normal point is closed, while the opposite polarity, the active state of the output 444, indicates that the Reverse point is closed. The inactive states of the outputs 436,444 indicate that neither point is closed. Thus, if the points are marginally closed with a gap to the stock rail of slightly greater than ⅛ inch, but less than ¼ inch, then the vital indication circuits (e.g., as provided by the signals 364,372), which are essential for maintaining movement of trains across the switch, remain functional. At the same time, however, the AUX Point Detected LEDs 520,526 being dark provides (along with a separate bipolar AUX output (not shown) to the wayside equipment (not shown)) a warning that adjustment of the switch machine 20 is in order, In this example, the signal 364 may be active (e.g., through AND gate 277 of FIG. 7) for the combination of PS1, PS2/, LS1 and LS2/, and the signal 436 may be active for the same combination of PS1, PS2/, LS1 and LS2/. Similarly, the signal 372 may be active (e.g., through AND gate 277R1) for the combination of PS1/, PS2, LS1/ and LS2, and the signal 444 may be active for the same combination of PS1/, PS2, LS1/ and LS2.

Further vitaogic is accomplished by the double pole-double throw contacts N1,N2 of the Normal coil 442 and the double pole-double throw contacts R1,R2 of the Reverse coil 450. When the coils 442,450 are not energized, the contacts N1,N2,R1,R2 are normally in the position as shown in FIG. 9, with the contact N1 shorting the terminals 384,386 through resistor 412, with the contact R1 shorting the terminals 390,392 through resistor 426, and with the contacts N2,R2 cooperating through conductor 456 and the resistor 458 to short the terminals 396,398. Otherwise, when the coil 442 is energized and the coil 450 is not energized, the contacts N1,N2,R2 cooperate to provide the Normal signal 394N. Similarly, when the coil 442 is not energized and the coil 450 is energized, the contacts R1,R2,N2 cooperate to provide the Reverse signal 394R.

Disagreement of the auxiliary indication (e.g., the AUX Point Detected LEDs 520,526 or the AUX bipolar output (not shown)) with that of the vital indication (e.g., the signals 364,372,382,388,394) provides an early warning and a mechanism by which the disagreement may be telemetered to a central control location (not shown) in order to summon maintenance of the switch machine 20, thereby potentially preventing a train delay. Alternatively, the condition may be noted in the wayside controocation (not shown) or directly by LED indications (FIG. 12) of the controller 22. Train delays are very costly and, thus, the potential to reduce them through preventative maintenance is important to railroads.

Shorting of the output terminals 384,386, 390,392, and 396,398 when the corresponding output is OFF is a safeguard against a stray voltage source, which might erroneously provide an ON output and, thus, falsely provide correspondence of the indication circuit to the switch machine request.

Referring to FIGS. 3, 7 and 9, the $\mu$P firmware 278 performs diagnostic tests on each of the proximity sensors PS1 44, PS2 46, LS1 52 and LS2 54 and the jumper 80 for selectors RHPC 84 and LHPC 82 to safely determine their true state. Although the exemplary embodiment does not perform such diagnostic tests for the AUX1 64 and AUX2 66 sensors, such test may be provided in accordance with the invention.

The Normal tuned amplifier 366 of FIG. 9 is an active circuit, which employs a suitable DC power source to sustain the Normal signal 382. With a single switch machine 20, this DC power source is provided by an exemplary wayside case (e.g., 476 of FIG. 10 having a 12 VDC battery 477), which powers the rest of the circuitry and which is interconnected at the terminal block (i.e., at N-B12 (+12 VDC) 460 and N-N12 (ground) 462, with jumpers (not shown) to R-B12 (+12 VDC) 464 and R-N12 (ground) 466 for the Reverse tuned amplifier 374).

Figure 10:
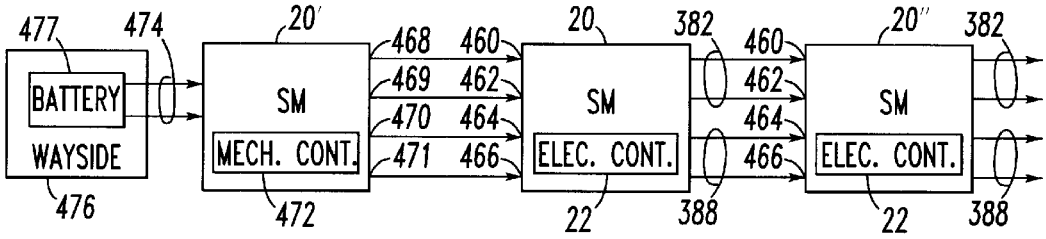
FIG. 10 is a block diagram in schematic form showing the series connection of the indication circuits of a plurality of switch machines in accordance with an embodiment of the present invention.

Alternatively, as shown in FIG. 10, the switch machine 20 is adapted for operation with another upstream switch machine 20' having +12 VDC 468 and ground 469 Normal power outputs, which are electrically connected to the +12 VDC 460 and ground 462, respectively, and +12 VDC 470 and ground 471 Reverse power outputs, which are electrically connected to the +12 VDC 464 and ground 466, respectively, of the downstream switch machine 20. The indication outputs 382 and 388 of the downstream switch machine 20 are employed to power a subsequent downstream switch machine 20". In the exemplary embodiment the upstream switch machine 20' employs a mechanical controller 472, while the two downstream switch machines 20,20" employ the electronic controller 22, although any combination of electronic and/or mechanical controllers may be employed.

As shown in FIG. 10, the indication circuits of a plurality of switch machines 20',20,20" are connected in series. For example, the normal output signal 382 at terminals 384,386 of the second switch machine 20 is connected to the terminal block (i. e., at N-B 12 (+12 VDC) 460 and N-N12 (ground) 462) of the third switch machine 20", and the reverse output signal 388 at terminals 390,392 of the second machine 20 is connected to the terminal block (i.e., at R-B12 (+12 VDC) 464 and R-N12 (ground) 466) of the third switch machine 20". Thus, the combination of power from the signals N-B12 460 and N-N12 462 and a suitable frequency of 1286 Hz determines the Normal output signal 382, and the combination of power from the signals R-B12 464 and R-N12 466 and a suitable frequency of 972 Hz determines the Reverse output signal 388.

The single battery input voltage 474 from the wayside case 476 then proves all switch machines 20',20,20" are in the proper state. In the exemplary embodiment, when two or more switch machines are involved, the voltage from the previous machine is employed to power the tuned amplifier. Thus, several machines fitted with the electronic controller 22 can be series connected. Alternatively, machines with the controller 22 can be series connected with conventional machines having mechanical circuit controllers, but with the same external electrical interfaces.

Referring again to FIG. 3, of significant importance is a "latch-out" fuinction, which is commonly employed by switch machines having cam-operated switches in the indication circuits. Latch-out is a term given from the root of its implementation: a mechanicaatch. Latch-out guards against reestablishing a Normal or Reverse output if the points open and then close again without the complete cycle of machine movement from Normal to Reverse or from Reverse to Normal. With mechanically controlled indication circuits, a spring operated latch opens the indication circuit and forces it to remain open even if the points were restored to close proximity to the stock rail. This could occur if a train passed through a switch layout in the wrong direction. It is deemed prudent by many railroads that the indication circuit should remain open even if the cam contacts would normally have restored the indication output because of suspect mechanical damage to the layout.

The latch-out feature is employed in the exemplary embodiment by suitable firmware 480 of the $\mu$P 94, rather than by a mechanical circuit. The firmware 480 ensures the points switch in sequence between the states of, for example, LS1 on and PS1 on, LS1 off, PS1 off, PS2 on, and LS2 on; or LS2 on and PS2 on, LS2 off, PS2 off, PS1 on, and LS1 on. If this sequence is not followed (e.g., LS1 on and PS1 on, PS1 off, LS1 off), then latch-out is set. In this example, in order to reset latch-out in the Automatic mode 90, the switch machine 20 is cycled from Normal to Reverse or from Reverse to Normal.

Three different selections of the jumper 86 are employed for latch-out: (1) Disable 92—latch-out is disabled and, as long as the AND gate logic of FIG. 7 is satisfied, then the indication outputs are available; (2) Automatic 90—the indication circuit may be restored by operating the switch machine 20, i.e., by moving the points and then returning them to the original position (e.g., this can be accomplished either locally or remotely by a dispatcher); and (3) Manual 88—a latch-out restore button 482 on the controller 22 must be activated and the status of the proximity sensors 44,46, 52,54 must be satisfied before the indication outputs can be restored (e.g., this forces visual inspection of the layout to ensure no damage has occurred that might jeopardize the safe passage of trains). Again, similar to the logic 359 of FIG. 7, suitable one, and only one, logic is employed to ensure against shorted wires that might potentially change the intended selection of the selectors Disable 92, Automatic 90, or Manual 88.

The two exemplary selection jumpers 80,86 are located in the junction box 72, which ensures that the corresponding selections will remain if the controller 22 is replaced. This is an important safety consideration because the person replacing a failed controller 22 would not necessarily know of: (a) the particular latch-out selection; or (b) the selection of one of the two sets (PS1/LS1 and PS2/LS2) of proximity sensors being assigned to Normal, both of which are critical to overall safety.

FIG. 11 shows motor control as practiced in mechanical machines wherein cam operated contacts 490,492 are employed to direct current through the motor 494 to control direction and to stop the motor at the end of the stroke. A permanent magnet motor and three-wire control 496 are employed. As shown in FIG. 11, the cam contact 490 is closed ("X") and the cam contact 492 is open. The arrows 498,500 show the direction of current needed to effect rotary motion to drive the machine Normal and Reverse, respectively. As shown, the machine 502 is in the Reverse position. With a positive voltage applied to terminal (1) 504 relative to terminal (2) 506, the motor 494 rotates to drive the machine 502 to the Normal position. As motion begins, the cam contact 492 closes and for most of the stroke both contacts 490,492 are closed in order that the machine 502 can be stopped and reversed. At the end of the Normal stroke, cam contact 490 opens the motor circuit and motion ceases. The cam contact 492 remains closed, however, and if voltage is applied with terminal (3) 508 positive with respect to terminal (1) 504, then it w initiate motion to drive the machine 502 to the original Reverse state. Here, separate cam contacts 490,492 are employed for the motor control circuit and the indication circuit (not shown).

Figure 12:
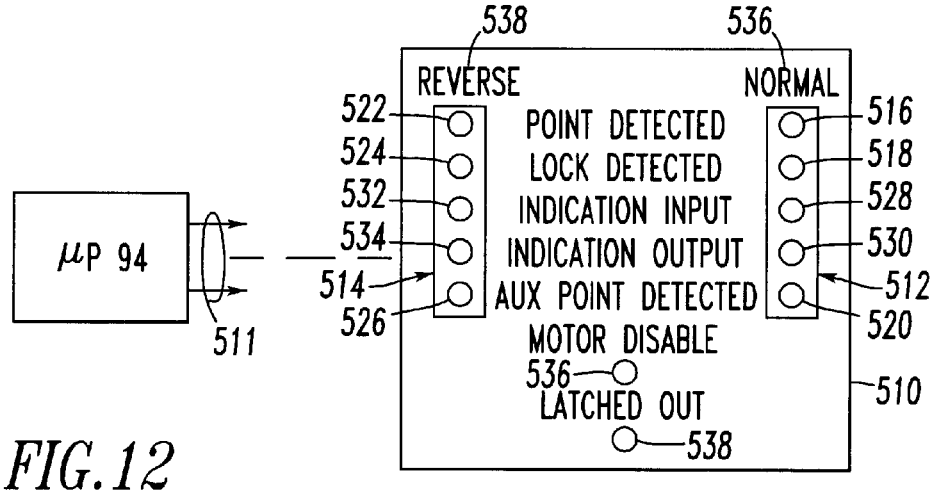
FIG. 12 is a representation of a configuration of indicators for the electronic controller of FIG. 3 in accordance with an embodiment of the present invention.

FIG. 12 shows the exemplary LED indicator configuration 510 for the controller 22 in which the $\mu$P 94 has a plurality of digital outputs 511, which drive the LEDs of this configuration through suitable buffers (not shown). This configuration 510 readily distinguishes the status of the switch machine 20 and guides a user, such as a maintainer, if it is not correctly functioning, in order to resolve whatever problem might exist. The configuration 510 includes a first array of indicators 512 for the normal state and a second array of indicators 514 for the reverse state. The first array of indicators 512 includes a first LED 516 for the first point position 32 in the normal state, a second LED 518 for the first lock position 36 in the normal state, and a third LED 520 for the first auxiliary point position 60 in the normal state. The second array of indicators 514 includes a first LED 522 for the second point position 34 in the reverse state, a second LED 524 for the second lock position 38 in the reverse state, and a third LED 526 for the second auxiliary point position 62 in the reverse state.

The arrays 512,514 also include an LED 528 to indicate the presence of normal indication input power (i.e., corresponding to the power signals 460,462 of FIG. 9, which signals are monitored through optical couplers (not shown)), an LED 530 to indicate the presence of normal indication output power (i.e., corresponding to Normal signal 382 of FIG. 9), an LED 532 to indicate the presence of reverse indication input power (i.e., corresponding to the power signals 464,466 of FIG. 9, which are also monitored through optical couplers (not shown)), and an LED 534 to indicate the presence of reverse indication output power (i.e., corresponding to Reverse signal 388 of FIG. 9).

In the exemplary embodiment, the arrays 512,514 form two columns of five LEDs under the headings of Normal 536 and Reverse 538, respectively. If in one (or the other) of these columns all the LEDs are green, then this shows that the switch machine 20 is working correctly. This is especially useful if two or more switch machines are series connected (FIG. 10) and the indication circuit is not complete. Hence, it enables a maintainer to immediately determine which of the switch machines is interrupting the circuit.

Also in the exemplary embodiment, the Point Detected LEDs 516,522 and the Lock Detected LEDs 518,524 are dual color. Green indicates on, red indicates off, and blinking red indicates a fault (e.g., any of the signals PS1,PS2,LS1,LS2 is indeterminate). The fault may be a shorted or open sensor. Alternatively, the fault may be that the target is not quite in range. For example, if the selector RHPC 84 (FIG. 3) is set to Normal, then the Normal Point Detected LED 516 is green for PS1 44 being on, and is, otherwise, red for PS1 44 being off. At the same time, the Reverse Point Detected LED 522 is green for PS2 46 being on, and is, otherwise, red for PS2 46 being off. Similarly, if the selector RHPC 84 is set to Normal, then the Reverse Point Detected LED 522 is green for PS2 46 being on, and is, otherwise, red for PS2 46 being off. Alternatively, if the LHPC 82 selector (FIG. 3) is set to Normal, then the Normal Point Detected LED 516 is green for PS2 46 being on, and is, otherwise, red for PS2 46 being off.

The exemplary LEDs 528,532 assigned to the Indication (Power) Input display either green or dark. Green designates suitable voltages (i. e., N-B12 and N-N12; R-B12 and R-N12) from the previous machine if the indication circuits are series connected, or a connection to a suitable battery if the switch machine is deployed by itself or if it is the first machine in a series string.

The exemplary LEDs 530,534 assigned to the Indication (Power) Output display either green or dark. For example, in order to satisfy the Indication (Power) Output LED 530, all of the corresponding Point Detected LED 516, Lock Detected LED 518, and Indication (Power) Input LED 528 must be green, in order to satisfy the Indication (Power) Output LED 530. Otherwise, if any one of those three preceding LEDs 516,518,528 is red, blinking red or dark, then the Indication (Power) Output LED 530 is dark.

The AUX Point Detected LEDs 520,526 are either green or dark. green indication shows that the points are closed tightly to the stock rail or that a machine is within the nominal adjustment. A dark LED calls attention to a machine needing adjustment. This advantageously provides an early warning before a train delay occurs because correspondence with the wayside switch request cannot be attained.

The Motor Disable LED 536 is normally dark. If either the hand throw lever 106 of FIG. 3 is activated or the hand crank 104 is activated, then this LED 536 displays red. This is a re-enforcement to the maintainer that motor power is cut when the hand movement option is exercised and that electrical operation of the machine will not occur to disrupt hand operation. Additionally, the Indication (Power) Output LEDs 530,534 switch to dark. The lack of such an Indication (Power) Output is interlocked via wayside logic (not shown) with the signal system, in order to prevent a train from being routed over the switch machine 20.

If the Indication (Power) Output LEDs 530,534 are dark with one of the Point Detected LEDs 516,522 being green, with the corresponding one of the Lock Detected LEDs 518,524 being green, and with the corresponding one of the Indication (Power) Input LEDs 528,532 being green, then it is because the machine is latched-out. The Latched Out LED 538 displays red, in order to advantageously remove any ambiguity as to why the Indication (Power) Out LEDs 530,534 are dark.

Thus, the exemplary LEDs of the configuration 510 provide a positive indication that the switch machine 20 is working properly and provide a guide to diagnose if the machine is not working properly without the need for additional instrumentation. In contrast, switch machines fitted with mechanical controllers provide no such diagnostic tools.

Figure 13:
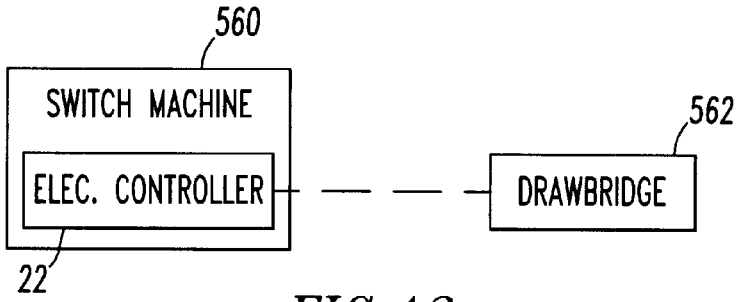
FIG. 13 is a block diagram of a switch machine for use with a drawbridge.

As shown in FIG. 13, the exemplary electronic controller 22 may be employed in another switch machine 560 in order to enhance safety in an application wherein the position of a drawbridge 562 is interlocked with railway signals.

The exemplary railroad switch machine 20 improves performances over known prior switch machines by employing improvements in electronic point and lock detection. The exemplary electronic controller 22 replaces a mechanical circuit controller and eliminates the need to replace worn mechanical parts, which affect the sensitivity of the controller and its ability to properly sense switch point displacement. The exemplary LED indication configuration 510 provides status information that clearly indicates if the switch machine 20 is operating properly and aids in diagnosing if a fault has occurred. Other diagnostics and displays call attention to the need to service the machine 20 before it becomes inoperative. Predictive auxiliary sensors 64,66 preclude failure of the indication circuit because they indicate nominal adjustment of the machine has deteriorated and imply further deterioration, thereby reducing train delays.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A controller for a switch machine including an indication rod having a target and also including a lock box having a target, the indication rod positionable between a first point position and a second point position, the lock box positionable between a first lock position and a second lock position, said controller comprising:

point detecting means for detecting when said indication rod is in said first point position and when said indication rod is in said second point position, said point detecting means including a first proximity sensor for detecting the target of said indication rod when said indication rod is in said first point position and a second proximity sensor for detecting the target of said indication rod when said indication rod is in said second point position, said first proximity sensor generating a first point detection signal and said second proximity sensor generating a second point detection signal, said first point detection signal having a value within a first predetermined range of values when said indication rod is in said first point position and having a value within a second predetermined range of values, which is different from said first predetermined range of values, when said indication rod is not in said first point position, said second point detection signal having a value within a third predetermined range of values when said indication rod is in said second point position and having a value within a fourth predetermined range of values, which is different from said third predetermined range of values, when said indication rod is not in said second point position;

lock detecting means for detecting when said lock box is in said first lock position and when said lock box is in said second lock position, said lock detecting means including a first proximity sensor for detecting the target of said lock box when said lock box is in said first lock position and a second proximity sensor for detecting the target of said lock box when said lock box is in said second lock position, said first proximity sensor of said lock detecting means generating a first lock detection signal and said second proximity sensor of said lock detecting means generating a second lock detection signal, said first lock detection signal having a value within a first predetermined range of values when said lock box is in said first lock position and having a value within a second predetermined range of values, which is different from said first predetermined range of values of said first lock detection signal, when said lock box is not in said first lock position, said second lock detection signal having a value within a third predetermined range of values when said lock box is in said second lock position and having a value within a fourth predetermined range of values, which is different from said third predetermined range of values of said second lock detection signal, when said lock box is not in said second lock position;

means for processing point detection information from said first and second point detection signals and said first and second lock detection signals to provide a first output and a second output, said means for processing enabling said first output when said first point detection signal has a value within the first predetermined range of values thereof, said second point detection signal has a value within the third predetermined ranges of values thereof, said first lock detection signal has a value within the first predetermined ranges of values thereof, and said second lock detection signal has a value within the third predetermined ranges of values thereof, said means for processing enabling said second output when said first point detection signal has a value within the second predetermined range of values thereof, said second point detection signal has a value within the fourth predetermined ranges of values thereof, said first lock detection signal has a value within the second predetermined ranges of values thereof, and said second lock detection signal has a value within the fourth predetermined ranges of values thereof, said means for processing disabling the first and second outputs when any of said first point detection signal has a value different than the first and second predetermined ranges of values thereof, said second point detection signal has a value different than the third and fourth predetermined ranges of values thereof, said first lock detection signal has a value different than the first and second predetermined ranges of values thereof, and said second lock detection signal has a value different than the third and fourth predetermined ranges of values thereof; and means for indicating the first and second outputs.

2. The controller of claim 1 wherein said first proximity sensor has two terminals; and wherein when the terminals of said first proximity sensor are open said first point detection signal has a value which is outside of the first and second predetermined ranges of values thereof.

3. The controller of claim 1 wherein said first proximity sensor has two terminals; and wherein when the terminals of said first proximity sensor are shorted said first point detection signal has a value which is outside of the first and second predetermined ranges of values thereof.

4. The controller of claim 1 wherein said means for indicating includes means for providing a first signal having a first frequency, means for detecting the first frequency and indicating the first output, means for providing a second signal having a second frequency which is different from the first frequency, and means for detecting the second frequency and indicating the second output.

5. The controller of claim 4 wherein said means for detecting the first frequency includes a first tuned amplifier and said means for detecting the second frequency includes a second tuned amplifier.

6. The controller of claim 5 wherein said switch machine is adapted for operation with another switch machine having first and second power outputs; and wherein the first and second tuned amplifiers have first and second power inputs which are powered from the first and second power outputs, respectively, of said another switch machine.

7. The controller of claim 1 wherein said means for processing point detection information is adapted for interconnection with an electronic controller for another switch machine.

8. The controller of claim 1 wherein said means for processing point detection information is adapted for interconnection with a mechanical controller for another switch machine.

9. The controller of claim 1 wherein said switch machine has a normal state and a reverse state; and wherein said means for processing point detection infonmation includes means for selectively associating the first output with one of the normal and reverse states.

10. The controller of claim 9 wherein said means for selectively associating includes a first selector and a second selector; and wherein said means for processing point detection information includes means for sensing the first and second selectors and disabling said first and second outputs when other than only one of said first and second selectors is selected.

11. The controller of claim 1 wherein said switch machine includes a hand throw lever having an activate state and a deactivate state, and a hand crank having an activate state and a deactivate state; and wherein said point detecting means further includes a sensor for said hand throw lever, a sensor for said hand crank, and means for disabling said first and second outputs when at least one of said hand throw lever and said hand crank has the active state thereof.

12. The controller of claim 1 wherein said point detecting means further includes a first auxiliary proximity sensor for detecting the target of said indication rod when said indication rod is in said first point position and a second auxiliary proximity sensor for detecting the target of said indication rod when said indication rod is in said second point position, said first auxiliary proximity sensor generating a third point detection signal and said second auxiliary proximity sensor generating a fourth point detection signal; wherein said first and second proximity sensors are adapted to detect the target of said indication rod being within a first distance of said first and second point positions, respectively; and wherein said first and second auxiliary proximity sensors are adapted to detect the target of said indication rod being within a second distance of said first and second point positions, respectively, with the second distance being less than the first distance.

13. The controller of claim 12 wherein said switch machine has a normal state and a reverse state; wherein said indication rod has a first auxiliary point position proximate the first point position and a second auxiliary point position proximate the second point position; and wherein said means for indicating includes a first array of indicators for said normal state and a second array of indicators for said reverse state, with the first array of indicators including a first indicator for the first point position in the normal state, a second indicator for the first lock position in the normal state, and a third indicator for the first auxiliary point position in the normal state, and with the second array of indicators including a first indicator for the second point position in the reverse state, a second indicator for the second lock position in the reverse state, and a third indicator for the second auxiliary point position in the reverse state.

14. The controller of claim 1 wherein the first and second proximity sensors of said point detecting means are inductive proximity sensors.

15. The controller of claim 14 wherein the first and second proximity sensors of said lock detecting means are inductive proximity sensors.

16. The controller of claim 1 wherein the first point detection signal of said point detecting means is indeterminate of the first and second point positions of said indication rod when said first point detection signal of said point detecting means has a value which is less than said first predetermined range of values of said point detecting means, greater than said first predetermined range of values of said point detecting means but less than said second predetermined range of values of said point detecting means, or greater than said second predetermined range of values of said point detecting means.

17. The controller of claim 1 wherein the second point detection signal of said point detecting means is indeterminate of the first and second point positions of said indication rod when said second point detection signal of said point detecting means has a value which is less than said third predeteermined range of values of said point detecting means, greater than said third predetermined range of values of said point detecting means but less than said fourth predetermined range of values of said point detecting means, or greater than said fourth predetermined range of values of said point detecting means.

18. The controller of claim 1 wherein said controller is adapted for operation with a railway switch machine.

19. The controller of claim 1 wherein said controller is adapted for operation with a drawbridge switch machine.

20. The controller of claim 1 wherein said switch machine has a normal state and a reverse state; and wherein said first and second outputs have a bipolar signal with a positive voltage between said first and second outputs to indicate the normal state of said switch machine, said bipolar signal having a negative voltage between said first and second outputs to indicate the reverse state of said switch machine.

21. The controller of claim 1 wherein said switch machine has a normal state and a reverse state; and wherein said means for indicating includes a first array of indicators for said reverse state and a second array of indicators for said normal state.

22. The controller of claim 21 wherein the first array of indicators includes a first indicator for the first point position in the normal state and a second indicator for the first lock position in the normal state; and wherein the second array of indicators includes a first indicator for the second point position in the reverse state and a second indicator for the second lock position in the reverse state.

23. The controller of claim 22 wherein the first point detection signal of said point detecting means is indeterminate of the first and second point positions of said indication rod when said first point detection signal of said point detecting means has a value which is less than said first predetermined range of values of said point detecting means, greater than said first predetermined range of values of said point detecting means but less than said second predetermined range of values of said point detecting means, or greater than said second predetermined range of values of said point detecting means; wherein the first point detection signal of said point detecting means is otherwise determinate of the first and second point positions of said indication rod; and wherein the first indicator for the first point position in the normal state of said first array has a static state corresponding to said first point detection signal of said point detecting means being determinate, and has a dynamic state corresponding to said first point detection signal of said point detecting means being indeterminate.

24. The controller of claim 23 wherein one of the first and second point detection signals is indeterminate of the first and second point positions of said indication rod when one of the first and second proximity sensors, respectively, of said point detecting means is shorted or open.

25. The controller of claim 22 wherein the first indicator for the first point position in the normal state of said first array has a first color corresponding to said indication rod being in said first point position and a second color corresponding to said indication rod being in said second point position; and wherein the first indicator for second point position in the reverse state of said second array has the first color corresponding to said indication rod being in said second point position and the second color corresponding to said indication rod being in said first point position.

26. The controller of claim 25 wherein the first lock detection signal of said lock detecting means is indeterminate of the first and second lock positions of said lock box when said first lock detection signal of said lock detecting means has a value which is less than said first predetermined range of values of said lock detecting means, greater than said first predetermined range of values of said lock detecting means but less than said second predetermined range of values of said lock detecting means, or greater than said second predetermined range of values of said lock detecting means; wherein the first lock detection signal of said lock detecting means is otherwise determinate of the first and second lock positions of said lock box; and wherein the first indicator for the first lock position in the normal state of said first array has a static state corresponding to said first lock detection signal of a said lock detecting means being determinate, and has a dynamic state corresponding to said first lock detection signal being indeterminate.

27. The controller of claim 26 wherein one of the first and second lock detection signals is indeterminate of the first and second lock positions of said lock box when one of the first and second proximity sensors, respectively, of said lock detecting means is shorted or open.

28. The controller of claim 26 wherein the second indicator for the first lock position in the normal state of said first array has the first color corresponding to said lock box being in said first lock position and the second color corresponding to said lock box being in said second lock position; and wherein the second indicator for the second lock position in the reverse state of said second array has the first color corresponding to said lock box being in said second lock position and the second color corresponding to said lock box being in said first lock position.

29. The controller of claim 28 wherein said means for indicating indicates proper operation of said switch machine when one of the first and second arrays has said first color.

30. The controller of claim 21 wherein said switch machine includes a hand throw lever having an activate state and a deactivate state, a hand crank having an activate state and a deactivate state, and a motor having an enabled state when said hand throw lever and said hand crank have the deactivate state, said motor having a disabled state when at least one of said hand throw lever and said hand crank have the activate state; and wherein said means for indicating includes an indicator adapted to indicate one of the enabled and disabled states of said motor.

31. The controller of claim 21 wherein said means for indicating includes a first indicator for the first point position in the normal state, a second indicator for the first lock position in the normal state, a third indicator adapted to indicate an input power condition from an upstream switch machine, and a fourth indicator adapted to indicate an output power condition to a downstream switch machine; wherein each of the first, second and third indicators has a normal state and at least one abnormal state; and wherein the fourth indicator has a normal state when each of the first, second and third indicators has the normal state.

32. The controller of claim 31 wherein said means for processing point detection information includes means for detecting a latch-out condition; and wherein said means for indicating further includes means for indicating said detected latch-out condition.

33. The controller of claim 1 wherein said means for processing point detection information includes:

an analog to digital converter having a plurality of analog inputs, a plurality of digital inputs to select one of the analog inputs, and a digital output having a value;

a processor having first and second outputs adapted to enable or disable a corresponding one of said first and second proximity sensors of said point detecting means, a plurality of outputs adapted to control the digital inputs of said analog to digital converter, an input electrically interconnected with the output of said analog to digital converter, and a routine to read the value of the digital output of said analog to digital converter;

a power supply having an output to power the first and second proximity sensors of said point detecting means;

first and second switches, each of said first and second switches having an output adapted to enable or disable a corresponding one of said first and second proximity sensors of said point detecting means, said first and second switches also having first and second inputs electrically interconnected with the first and second outputs, respectively, of said processor; and first and second dividers, each of said dividers having an input electrically interconnected with a corresponding one of the first and second outputs of said first and second switches, each of said dividers also having an output with a unique voltage electrically interconnected with one of the analog inputs of said analog to digital converter, whereby the routine of said processor reads the value of the output of said analog to digital converter corresponding to one of said first and second proximity sensors, reads the value of the digital output of said analog to digital converter corresponding to one of said first and second dividers, and determines if the value of the digital output of said analog to digital converter corresponding to one of said first and second dividers is within a predetermined value of a corresponding one of the unique voltages.

34. The controller of claim 33 wherein the routine of said processor reads the value of the digital output of said analog to digital converter corresponding to the other one of said first and second proximity sensors, and determines if the last said value is within a predetermined value of zero, in order to determine that said other one of said first and second proximity sensors was disabled.

35. The controller of claim 1 wherein said means for processing point detection information includes a digital to analog converter having an digital input and an analog output; an analog to digital converter having an analog input electrically interconnected with the analog output of said digital to analog converter and a digital output having a value; and a processor having an output electrically interconnected with the digital input of said digital to analog converter to output one of a predetermined set of values thereto, said processor also having an input electrically interconnected with the digital output of said analog to digital converter to read said digital output of said analog to digital converter and to determine if the value of the digital output of said analog to digital converter is within a predetermined value of said one of a predetermined set of values.

36. The controller of claim 1 wherein said means for processing point detection information includes means for providing an output having a unique voltage value; an analog to digital converter having an analog input electrically interconnected with the output of said means for providing, a digital output having a value, and a plurality of analog inputs electrically interconnected with the first and second proximity sensors of said point detecting means; and a processor having an input electrically interconnected with the digital output of said analog to digital converter to read said digital output of said analog to digital converter and determine if the value of the digital output of said analog to digital converter is within a predetermined value of said unique voltage value.

37. The controller of claim 1 wherein said means for processing point detection information includes a power supply having an output to power the first and second proximity sensors of said point detecting means; a divider having an input electrically interconnected with the output of said power source, said divider having an output; and an analog to digital converter having an analog input electrically interconnected with the output of said divider and a digital output having a value; and a processor having an input electrically interconnected with the digital output of said analog to digital converter to read the value of the digital output of said analog to digital converter and to determine if the last said value is within a predetermined range of values.

38. The controller of claim 1 wherein the first predetermined range of values of said first point detection signal, the fourth predetermined range of values of said second point detection signal, the first predetermined range of values of said first lock detection signal and the fourth predetermined range of values of said second lock detection signal have the same range of values.

39. The controller of claim 1 wherein the second predetermined range of values of said first point detection signal, the third predetermined range of values of said second point detection signal, the second predetermined range of values of said first lock detection signal and the third predetermined range of values of said second lock detection signal have the same range of values.

40. The controller of claim 10 wherein said means for processing point detection information includes a processor and a separate junction box including the first selector and the second selector.

* * * * *

UNITED STATES PATENT AND TRADEMARK OFFICE

CERTIFICATE OF CORRECTION

PATENT NO. : 6,484,974 B1
DATED : November 26, 2002
INVENTOR(S) : Raymond C. Franke et al.

It is certified that error appears in the above-identified patent and that said Letters Patent is hereby corrected as shown below:

Column 1,
Line 19, "one track to," should read -- one track to --.
Line 55, "contacts in the," should read -- contacts in the --.

Column 4,
Line 45, "respect to the track," should read -- respect to the track --.

Column 5,
Line 21, remove "a" after -- voltage --.

Column 6,
Line 15, remove "is,".

Column 7,
Line 54, remove "kits;".

Column 8,
Line 11, "UP" should read -- μP --.
Line 30, "ajunction" should read -- a junction --.

Column 9,
Line 18, "throwlever" should read -- throw lever --.
Line 22, after "terminal" insert -- 110 --.
Line 25, after "terminal" insert -- 111. --.
Line 62, after "on" insert a -- . --.

Column 11,
Line 21, remove the "," prior to -- input --.
Line 39, start a new paragraph with "These measurements".

Column 12,
Line 59, start a new paragraph with "After".

UNITED STATES PATENT AND TRADEMARK OFFICE

CERTIFICATE OF CORRECTION

PATENT NO. : 6,484,974 B1 
DATED : November 26, 2002
INVENTOR(S) : Raymond C. Franke et al.

It is certified that error appears in the above-identified patent and that said Letters Patent is hereby corrected as shown below:

Column 13,
Line 51, "UP" should read -- μP --.

Column 14,
Line 47, after "signaling system." start a new paragraph with -- The --.

Column 18,
Line 19, "vitaogic" should read -- vital logic --.
Line 42, "controocation" should read -- control location --.

Column 19,
Line 45, "fuinction" should read -- function --.
Line 48, "mechanicaatch" should read -- mechanical latch --.

Column 20,
Line 51, "w" should read -- will --.

Column 24,
Line 50, "infonmation" should read -- information --.

Column 25,
Line 56, "predeteermined" should read -- predetermined --.

Signed and Sealed this

Fifteenth Day of July, 2003

JAMES E. ROGAN
*Director of the United States Patent and Trademark Office*